US006709092B2

(12) United States Patent
Hayashi et al.

(10) Patent No.: US 6,709,092 B2
(45) Date of Patent: Mar. 23, 2004

(54) RECORDING LIQUID FEED PATH, RECORDING LIQUID CONTAINER, AND RECORDING LIQUID FEED DEVICE HAVING SAME, AS WELL AS SURFACE MODIFYING METHOD FOR THE RECORDING LIQUID FEED DEVICE

(75) Inventors: Hiroki Hayashi, Kawasaki (JP); Sadayuki Sugama, Tsukuba (JP); Shozo Hattori, Ohta-ku (JP); Hajime Yamamoto, Yokohama (JP); Eiichiro Shimizu, Yokohama (JP); Mikio Sanada, Yokohama (JP); Hiroshi Koshikawa, Kawasaki (JP); Kenji Kitabatake, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 195 days.

(21) Appl. No.: 09/726,025

(22) Filed: Nov. 30, 2000

(65) Prior Publication Data

US 2001/0035897 A1 Nov. 1, 2001

(30) Foreign Application Priority Data

Dec. 6, 1999 (JP) ..... 11-346915

(51) Int. Cl.[7] ..... B41J 2/175
(52) U.S. Cl. ..... 347/86
(58) Field of Search ..... 347/85, 86, 87, 347/92; 521/52, 53

(56) References Cited

U.S. PATENT DOCUMENTS

| | | | | |
|---|---|---|---|---|
| 5,509,140 A | | 4/1996 | Koitabashi et al. | 347/86 |
| 6,077,235 A | * | 6/2000 | Serpentino et al. | 600/573 |
| 6,142,606 A | | 11/2000 | Kubota et al. | 347/45 |
| 6,234,618 B1 | | 5/2001 | Yamamoto et al. | 347/86 |
| 6,312,115 B1 | * | 11/2001 | Hara et al. | 347/86 |
| 2001/0007274 A1 | * | 7/2001 | Sanada et al. | 156/329 |
| 2001/0007463 A1 | | 7/2001 | Hayashi et al. | 347/86 |

FOREIGN PATENT DOCUMENTS

| | | | |
|---|---|---|---|
| EP | 887190 | | 12/1998 |
| EP | 900 875 | * | 3/1999 |
| EP | 945272 | | 9/1999 |
| EP | 960732 | | 12/1999 |
| JP | 4-173345 | | 6/1992 |

* cited by examiner

*Primary Examiner*—Michael Nghiem
(74) *Attorney, Agent, or Firm*—Fitzpatrick, Cella, Harper & Scinto

(57) ABSTRACT

To provide a recording liquid feed path, recording liquid container, and recording liquid feed device having the same, as well surface modifying method for the recording liquid feed device to feed efficiently a recording liquid for ejection through a feed tube. If the interior of the feed tube is not rendered hydrophilic as shown in FIG. 3A, air which has passed through a wall of the feed tube forms a bubble, which bubble adheres to an inner surface of the feed tube and obstructs a flow of the recording liquid. But if the inner surface of the feed tube is rendered hydrophilic to form a hydrophilic surface as shown in FIG. 3B, the recording liquid is conducted along the hydrophilic surface at the inner surface portion of the feed tube with the bubble adhered thereto, so that the adhesion area of the bubble to the feed tube inner surface is reduced and the bubble floats from the inner surface. Consequently, when the recording liquid is fed, the bubble can be removed easily by the flow of the recording liquid and thus the flow of the recording liquid can be prevented from being obstructed by the bubble.

6 Claims, 28 Drawing Sheets

UNTREATED 150×

UNTREATED 500×

UNTREATED 2000×

ACIDIZED 150×

HYDROPHILICALLY TREATED 150×

HYDROPHILICALLY TREATED 500×

HYDROPHILICALLY TREATED 2000×

RECORDING LIQUID FEED PATH, RECORDING LIQUID CONTAINER, AND RECORDING LIQUID FEED DEVICE HAVING SAME, AS WELL AS SURFACE MODIFYING METHOD FOR THE RECORDING LIQUID FEED DEVICE

BACKGROUND OF THE INVENTION

1. Field of the Invention

The present invention relates to a recording liquid container for containing a recording liquid (ink), a recording liquid feed path through which the recording liquid contained in the recording liquid container is conducted to an ink jet head which ejects a recording liquid for adhesion to a recording medium to effect recording, and a recording liquid feed device provided with the recording liquid container and the recording liquid feed path, as well as a hydrophilization method for a surface of a portion of the recording liquid feed device through which portion the recording liquid passes directly and also for the surface of a part of a structure such as a filter which is necessary for the feed of the recording liquid.

The present invention further relates to an element surface modifying method for modifying characteristics and properties of either surfaces of fibers themselves which are used as a negative pressure generating member within the recording liquid container or the said surfaces which have been subjected to a certain treatment, to improve their liquid contact property. The invention still further relates to the so-surface-modified negative pressure generating member.

In addition, the present invention particularly relates to a surface modifying method capable of surely modifying the surfaces of fibers constituted by olefin resins which are difficult to be surface-treated but are environment-friendly, as well as fibers having so-modified surfaces and a method for preparing the fibers.

2. Related Background Art

In an ink jet printer of a type in which a recording liquid (ink) is ejected from an ink jet head and is adhered to a recording medium to effect recording, there generally is provided a recording liquid feed device, which device includes a recording liquid container for containing ink to be fed to an ink jet head and also includes a recording liquid feed path for conducting ink from an ink tank to the ink jet head.

In the case where the recording liquid container and the ink jet head are spaced apart from each other, a flexible plastic tube or the like is used as the recording liquid feed path, and even when there is used a recording liquid container integral with or removable from the ink jet head, there sometimes is used a pipe-like communication member (joint pipe). Usually, a filter is disposed within the path between the head and the tank.

In a recording liquid feed device in which such a feed tube 1001, e.g., a plastic tube, as shown in FIGS. 35A and 35B are used as the aforesaid recording liquid feed path, ink present within the feed tube 1001 evaporates into gas, which gas permeates through the wall of the feed tube 1001 and is discharged to the exterior. It follows that a trace of air enters the feed tube 1001 through the wall of the tube 1001, which entry of air may result in formation of a bubble 1002 within the tube 1001, as shown in FIG. 35A. The bubble 1002 if formed within the feed tube 1001 causes the ink flow path to become narrower, with consequent obstruction to the flow of ink, which may lead to a deficient supply of ink.

Further, if such a state is left as it is over a long period, the bubble will grow into a larger bubble 1002, which may cause separation of the ink present within the feed tube 1001 and formation of meniscuses 1003, as shown in FIG. 35B. Such a state influences the flow of ink and may result in ink being unable to be fed. In this case, even if an attempt is made to recover the continuity of the feed tube 1001, for example by using a pump to suck out the ink from the interior of tube 1001, it may be impossible to recover the tube continuity unless a considerably large force is used.

If a gas barrier layer through which air is difficult to permeate is formed on the wall of the feed tube 1001, the formation of bubbles 1002 may be diminished. With such a gas barrier layer, however, the feed tube 1001 becomes thicker and occupies a larger space. Besides, the feed pipe becomes hard and may be cracked upon imposition of a stress thereon when bent so as to be disposed within the ink jet printer or when the ink jet head moves together with a carriage which carries the ink jet head thereon.

In a recording liquid container having an absorber containing chamber and a liquid storage chamber, the absorber containing chamber having a gas inlet path formed therein for the promotion of gas-liquid exchange, the entry of air into the gas inlet path forms an air path and the entry of the air into liquid storage chamber relieves the internal pressure. In this case, the air moving time dominates an increase in negative pressure during the supply of liquid, so it is preferable that the air move smoothly without the need of increasing a capillary force of the gas inlet path for gas-liquid exchange.

In the case of a recording liquid container in which the liquid storage chamber is replaceable, a joint pipe as an ink flow path, which is relatively long in a lateral direction (horizontal direction), is laid between the liquid storage chamber and the absorber containing chamber, there sometimes occurs a case where the introduction of ink from the liquid storage chamber into the absorber containing chamber is not performed smoothly. Particularly, for example when the ink jet printer is placed obliquely and hence the joint pipe is inclined upward toward the absorber containing chamber, there is a fear that the introduction of ink may not be done smoothly, with consequent exhaustion of ink.

SUMMARY OF THE INVENTION

The present invention intends to solve the above-mentioned problems and provide a recording liquid feed path, a recording liquid container, and a recording liquid feed device provided with them, capable of effecting the movement of ink smoothly within a liquid flow path from the recording liquid container to a liquid ejection head/(preferably also within the recording liquid container).

In the case of an ink tank with a compressed member disposed within a liquid feed port of a recording head, the compressed member being constituted by a bundle of fibers which are arranged in alignment with a liquid feed direction, if an ink flow resistance of the compressed member is high and if ink is to be fed at a high flow rate to meet the requirement for high-speed printing, then from the same viewpoint as above, there arises the problem that it is no longer possible to feed ink stably to the head.

The present invention is an epoch-making invention based on a new knowledge found out during our studies about the conventional technical level.

According to the conventional surface modifying method by only a chemical bond based on radical formation, it is impossible to modify a surface of a complicated shape uniformly. Particularly, surface modification is infeasible for the interior of a negative pressure generating member having a complicated porous portion in the interior thereof such as sponge or a fiber composite which is used in the ink jet field for generating a negative pressure.

Besides, if the liquid used contains a surfactant, the porous portion is not surface-modified, and upon extinction of the surfactant the liquid exhibits no characteristic and the characteristic of the surface itself also reverts to its original state immediately.

Olefin resins are superior in water repellence as can be seen from their contact angles as high as 80° or more relative to water, but no method is available for ensuring a desired lyophilic nature over a long period.

Having therefore made studies for finding out a method capable of surface-modifying olefin resins in a rational manner and maintaining the thus-modified characteristic and for eventually providing a method capable of surface-modifying all kinds of elements, the present inventors noted the use of a treating liquid and premised that even a negative pressure generating member of a complicated structure could be treated thereby.

Moreover, in connection with the relation between a to-be-modified surface of a negative pressure generating member and a polymer containing a reactive group, we have newly found out that the balance with the reactive group can be controlled to a desired state by utilizing surface energy and that the durability and quality stability can be further improved by analysis of the polymer itself.

Having also paid attention to a negative pressure characteristic of such a negative pressure generating member as a porous member from another viewpoint, we encountered the following problem.

A conventional negative pressure generating member is in many cases exposed to liquid such as a liquid ink filled in an initial stage.

In the case where a negative pressure chamber and a liquid containing chamber are integral with each other, a portion of the negative pressure generating member exposed to the liquid consumes the liquid, which consumed quantity of the liquid may be replenished. However, the interior of the device concerned, which is in a normal condition, does not assume that the liquid will be replenished to the negative pressure generating member which consumes the liquid as a whole. Thus, it is uncertain even for those skilled in the art whether a return to the initial negative pressure or to the initial liquid retention will be attained or not by the replenishment of liquid.

Having made a further study about what degree of return will be attained by mounting a replenishing liquid containing chamber (a container or a tank) after the liquid contained in a negative pressure generating member containing chamber has been consumed at an arbitrary level, we found out that the amount of the liquid filled into the negative pressure generating member in an initial stage was fairly large because of forced pouring of the liquid by some suitable means, but that a mere re-filling of the liquid afforded only about a half return probably due to a difficult removal of air contained in the negative pressure generating member, and that if such a mere replenishment of liquid is repeated, the amount of liquid capable of being retained would become more and more smaller and an increase in negative pressure also resulted.

It is a first object of the present invention to provide a liquid feed path in which even when a bubble is present in a liquid feed tube portion leading to a liquid ejection head, the path can be recovered by suction or the application of pressure using recovery means.

It is a second object of the present invention to provide a liquid feed path having a lyophilized surface formed on an inner surface thereof, the lyophilized surface being formed using a thin polymer film of a molecular level which causes little change in the inside diameter of the path and the manufacturing method therefor.

It is a third object of the present invention to provide a containing chamber capable of containing liquid to be fed to a liquid ejection head and improved in liquid movability and recoverability in a joint potion (connector portion) of a negative pressure generating member containing chamber to and from which a removable liquid feed member is connected and removed, and also provide a containing chamber involving a lyophilization treatment for at least a part of a negative pressure generating member. It is also an object of the invention to provide a containing chamber and a system both capable of ensuring the introduction of gas (outside air) which is performed together with the supply of liquid into a negative pressure generating chamber by the liquid feed member.

It is a fourth object of the present invention to provide a liquid feed tube manufacturing method for ensuring a lyophilic nature of an inner surface of an olefin resin tube for a liquid ejection head, as well as a liquid feed tube manufactured by the method.

It is a fifth object of the present invention to provide structural members such as a tube, a pipe, and a filter capable of exhibiting a lyophilic nature and also exhibiting air permeability and elution preventing effect in a liquid feed path formed within a liquid ejection device.

Other objects of the present invention and combined objects of the above objects will be understood from the following description.

For achieving the above-mentioned objects, according to the present invention there is provided a tubular recording liquid feed path as path portion through which a recording liquid passes directly or as a structure necessary for the feed of the recording liquid, to feed the recording liquid to an ink jet head which ejects the recording liquid to effect recording, in which a polymer is applied to an inner surface of the recording liquid feed path, the polymer having a first moiety containing a lyophilic group for making the inner surface of the recording liquid feed path hydrophilic and a second moiety containing a group having an interfacial energy different from an interfacial energy of the lyophilic group and almost equal to a surface energy of the said surface, the second moiety being oriented toward the said surface which direction is different from an orienting direction of the first moiety.

According to this construction, when air permeates through the wall of the recording liquid feed path and forms a bubble in the interior of the same path, the recording liquid is conducted along the hydrophilized inner surface of the recording liquid feed path in the wall portion of the same path with the bubble adhered thereto, so that the area of bubble adhesion to the inner surface of the path becomes small; besides, the bubble leaves the inner surface of the path and floats. Consequently, the bubble can be removed easily by the flow of liquid during feed of the liquid and thus the stay of the bubble within the path can be shortened. Consequently, the flow of the recording liquid can be prevented from being obstructed by the bubble and the recording liquid can be fed efficiently.

If a bubble adheres to the inner surface of the recording liquid feed path, the osmotic pressure of the recording liquid in this bubble-adhered portion of the path becomes smaller, thus promoting the permeation of air into the same path. However, in the recording liquid feed path according to the present invention, since the area of bubble adhesion to the inner surface of the recording liquid feed path can be made small, the permeation of air into the recording liquid feed path, which is caused by a lowering of the osmotic pressure of the recording liquid, can be prevented from being accelerated.

Since the hydrophilized inner surface of the recording liquid feed path according to the present invention is low in flow resistance during movement of the recording liquid, the recording liquid can be fed more efficiently through the recording liquid feed path.

For effecting this hydrophilization, the inner surface of the recording liquid feed path may be constituted by an olefin resin, and a polyalkylsiloxane containing a hydrophilic group may be used as a polymer.

According to the present invention there is further provided a recording liquid feed system comprising a first container, the first container containing an absorber which holds a recording liquid to be fed to an ink jet head temporarily with a capillary force, a second container which holds a recording liquid to be fed to the first container, and a tubular recording liquid feed path for communication between the first and second containers, in which the absorber is a fibrous member constituted by fibers which contain an olefin resin at least on their surfaces, an inner surface of the recording liquid feed path has an olefin resin, the surface of the fibrous member and the inner surface of the recording liquid feed path are each applied with a polymer at least partially, the polymer having a first moiety containing a lyophilic group for lyophilization and a second moiety containing a group having an interfacial energy different from an interfacial energy of the lyophilic group and almost equal to a surface energy of the said surfaces, the second moiety being oriented toward the said surfaces, and the first moiety being oriented in a direction different from the said surfaces.

According to this construction, since the surface of the fibrous member contained in the absorber is hydrophilized, the surfaces of the constituent fibers are high in wettability, so that the absorption of ink by the fibrous absorber is fast and there can be attained an efficient feed of ink to the absorber. Besides, since the flow resistance during movement of the ink is low in the fibrous absorber portion, it is possible to conduct the ink to the ink jet head efficiently.

According to the present invention there is further provided a recording liquid container containing a recording liquid to be fed to an ink jet head which ejects a recording ink for adhesion to a recording medium to effect recording, in which a partial surface of a portion through which the recording liquid passes directly or a partial surface of a structure necessary for feeding the recording liquid is hydrophilized.

According to this construction, there can be obtained a recording liquid container capable of feeding a recording liquid stably and efficiently.

More specifically, according to the present invention there is provided a recording liquid container including a filter disposed in a feed port portion for the feed of a recording liquid to an ink jet head, in which the surface of the filter is hydrophilized.

By so making the filter hydrophilic it is possible to diminish a pressure loss caused by the filter and conduct a recording liquid held in an ink cartridge to the filter portion efficiently and feed it to the exterior.

According to the present invention there is further provided a recording liquid container comprising an absorber containing chamber and a liquid storage chamber, the absorber containing chamber containing an absorber and being provided with an atmosphere communication port and a liquid feed port, the absorber functioning to hold liquid by utilizing a capillary force, and the liquid storage chamber communicating with the absorber containing chamber through a communicating portion and defining a substantially sealed space except the communicating portion, in which a housing of the absorber containing chamber is lyophilized at a surface of contact thereof with the absorber at least in the vicinity of the communicating portion.

According to this construction, at the surface of contact with the absorber on the side where the communicating portion is connected to the absorber containing chamber, even if there is a slight gap between the absorber containing chamber and the absorber, the recording liquid held by the absorber can be conducted to the said gap and held therein, whereby it is possible to prevent air from being conducted through the gap to the communicating portion and hence possible to effect gas-liquid exchange stably.

According to the present invention there is further provided a recording liquid container containing an absorber and provided with an atmosphere communication port and a liquid feed port, the absorber functioning to hold a recording liquid by utilizing a capillary force, and further provided with a joint pipe for introducing the recording liquid into the absorber, in which an inner surface of the joint pipe is lyophilized.

By thus making the inner surface of the joint pipe hydrophilic it is possible to conduct the recording liquid stored in the liquid storage chamber to the joint pipe portion efficiently and feed it into the absorber containing chamber.

In this case, by making the inner surface of a lower portion of the joint pipe hydrophilic, thereby allowing ink to pass through a lower portion of the pipe and allowing air to pass through an upper portion of the pipe, it is possible to effect gas-liquid exchange in a more stable manner.

Further, if an inner surface of a connection port of the liquid storage chamber for connection with the joint pipe is made liquid-repellent, it becomes possible to prevent the recording liquid from staying in the connection port of the liquid storage chamber when the same chamber is removed from the absorber containing chamber.

It is preferable that the absorber be constituted by a fibrous member and that both a portion of the fibrous member corresponding to the liquid feed port and a surrounding portion thereof be subjected to a lyophilizing treatment at least partially. By so doing it is possible to improve the recording liquid absorbability of the absorber and decrease the flow resistance of the recording liquid contained in the absorber.

The lyophilizing treatment according to the present invention for a partial surface of a portion of the recording liquid container through which the recording liquid passes directly or for the surface of a part of a structure necessary for the feed of the recording liquid is characterized in that a polymer is applied to the surface to be rendered lyophilic, the polymer having a first moiety containing a lyophilic group for making the surface lyophilic and a second moiety containing a group having an interfacial energy different from an interfacial energy of the lyophilic group and almost equal to a surface energy of the said surface, the second moiety being oriented toward the said surface, and the first moiety being oriented in a direction different from the said surface.

According to the present invention there is further provided a recording liquid feed device for feeding a recording liquid to an ink jet head which ejects the recording liquid for adhesion to a recording medium to effect recording, in which a polymer is applied to a partial surface of a path portion through which the recording liquid passes directly and is applied also to a partial surface of a part of a negative pressure generating member which feeds the recording liquid while generating a negative pressure, the polymer having a first moiety containing a lyophilic group for making the said surfaces lyophilic and a second moiety containing a group having an interfacial energy different from an interfacial energy of the lyophilic group and almost equal to a surface energy of the said surfaces, the second moiety being oriented toward the said surfaces, and the first moiety being oriented in a different direction.

More specifically, the recording liquid feed device according to the present invention is characterized by having the foregoing recording liquid feed path or recording liquid container.

According to the present invention there is further provided a surface modifying method for lyophilizing or liquid-repelizing a partial surface of a path portion through which a recording liquid passes directly in a recording liquid feed device for feeding the recording liquid to a liquid ejection head or a partial surface which constitutes a part of a filter necessary for feeding the recording liquid, with a functional group for the lyophilization or liquid-repellant treatment being imparted to the partial surface, the method comprising:

a first step of applying liquid containing fragmented products to the partial surface, the fragmented products having a first moiety containing a functional group and a second moiety containing a group having an interfacial energy different from an interfacial energy of the functional group and almost equal to a surface energy of the partial surface, the fragmented products being obtained by cleavage of a functional group imparting polymer having the first and second moieties;

a second step of orienting the second moiety of the fragmented products to the partial surface side and orienting the first moiety to a side different from the partial surface side; and a third step of condensing and polymerizing at least partially the fragmented products oriented on the partial surface.

Further, a surface modifying method according to the present invention is characterized by comprising:

a first step of applying a solution to a surface in which solution are dissolved a dilute acid, an affinity improver for improving volatility and affinity for an element surface, and a treating agent containing a polymer, the polymer having a second moiety and a first moiety, the second moiety containing a group having an interfacial energy almost equal to a surface energy of the surface, and the first moiety containing a group of an interfacial energy different from the said interfacial energy;

a second step of imparting heat to the surface to remove the affinity improving agent;

a third step of concentrating the dilute acid and allowing the polymer contained in the treating agent to be cleaved; and a fourth step of condensing the cleaved polymer on the surface, orienting the second moiety of the polymer toward the said surface, and orienting the first moiety to a side different from the said surface.

According to this surface modifying method it is possible to conduct a uniform and continuous surface modifying treatment. By so modifying the surface it is possible to improve the fluidity of a recording liquid which comes into contact with the surface.

Thus, according to the present invention, the wettability of ink for the liquid feed path as a path portion through which the recording liquid passes directly or as a structure necessary for the feed of the liquid is improved, the adhesion of a bubble becomes difficult, a bubble even if formed is difficult to grow even when left standing over a long period, the adhesion and staying of a bubble within the liquid feed path are suppressed, and the ink feedability is difficult to be deteriorated.

Further, by applying the hydrophilizing treatment to a partition wall on a absorber containing chamber side in a liquid container having the partition wall, it is possible to prevent an accidental occurrence of an air path between the wall surface and the absorber and it is possible to effect the introduction of gas through a predetermined route, thus permitting gas-liquid exchange to be carried out stably and permitting improvement of the reliability in the feed of liquid.

BRIEF DESCRIPTION OF THE DRAWINGS

FIGS. 3A and 3B are enlarged views showing a characteristic of feed tubes 302 of the recording liquid feed device shown in FIG. 2, of which FIG. 3A is a sectional view of a feed tube 302, on which a hydrophilized surface 316 is not formed, as a reference example and FIG. 3B is a sectional view of a feed tube 302, on which the hydrophilized surface 316 is formed, used in the first embodiment;

FIGS. 5A and 5B are schematic diagrams of an ink cartridge as a constituent of a recording liquid feed device according to the third embodiment of the present invention, of which FIG. 5A is a sectional view and FIG. 5B is a perspective view of a partition wall 54 portion;

FIGS. 7A and 7B are schematic diagrams of the ink jet head cartridge shown in FIG. 6, of which FIG. 7A is a brief sectional view of the whole of the cartridge and FIG. 7B is an enlarged sectional view of a joint pipe 61 portion;

FIGS. 13A and 13B are diagrams each showing a form of adhesion between a polymer as a surface modifier formed on a to-be-modified surface of an element (a base) and the surface of the element in a surface modifying method applicable to the invention, of which FIG. 13A illustrates a case where both a first group as a functional group and a second group for adhesion to the element surface are contained in the side chain of the polymer and FIG. 13B illustrates a case where the second group is contained in the main chain of the polymer;

FIGS. 21A, 21B, 21C and 21D illustrate a PE-PP fibrous member utilized as an ink absorber in an ink tank, of which FIG. 21A shows schematically a form of utilization as an ink absorber in an ink tank, FIG. 21B shows schematically an entire shape of the PE-PP fibrous member, as well as an arranged direction Fl of constituent fibers and a direction F2 orthogonal thereto, FIG. 21C shows schematically a state before heat-fusion of the PE-PP fibrous member, and FIG. 21D shows schematically a heat-fused state of the PE-PP fibrous member;

FIGS. 22A and 22B show examples of sectional structures of the PE-PP fibrous member illustrated in FIGS. 21A to 21D, of which FIG. 22A shows schematically an example of coating a PE sheath onto a PP core substantially concentrically and FIG. 22B shows schematically an example of coating a PE sheath onto a PP core eccentrically;

FIGS. 23A, 23B, 23C, 23D, 23E and 23F show an example of applying a surface modifying method according to the present invention to a hydrophilizing treatment for a water-repellent surface of the PE-PP fibrous member illustrated in FIGS. 21A to 21D, of which FIG. 23A shows schematically the fibrous member before treatment, FIG. 23B shows schematically a step of dipping the fibrous member into a treating solution for hydrophilization, FIG. 23C schematically shows a subsequent step of compressing the fibrous member and removing a surplus portion of the treating solution, and FIGS. 23D to 23F are partial enlarged diagrams of FIGS. 23A to 23C, respectively;

FIG. 24B shows schematically a step of drying off a solvent contained in the coating layer, FIG. 24C shows schematically a coating of a hydrophilizing agent which covers the surface of the fibrous member, and FIGS. 24D to 24F are partial enlarged diagrams of FIGS. 24A to 24C, respectively;

DETAILED DESCRIPTION OF THE PREFERRED EMBODIMENTS

Embodiments of the present invention will be described hereinunder with reference to the accompanying drawings.

Being superior in wettability for a liquid contained is designated "lyophilic" or "lyophilic nature" in the present invention. The ink used in the following embodiments is a water-based ink, and in connection with the lyophilic nature reference will be made particularly to hydrophilic nature in the following embodiments. However, inks employable in the present invention are not limited to aqueous inks, but oily inks are also employable, in which case it is lipophilic nature that is imparted to a surface.

(First Embodiment)

The first embodiment will be described below with reference to FIGS. 1 and 2.

Figure 1:
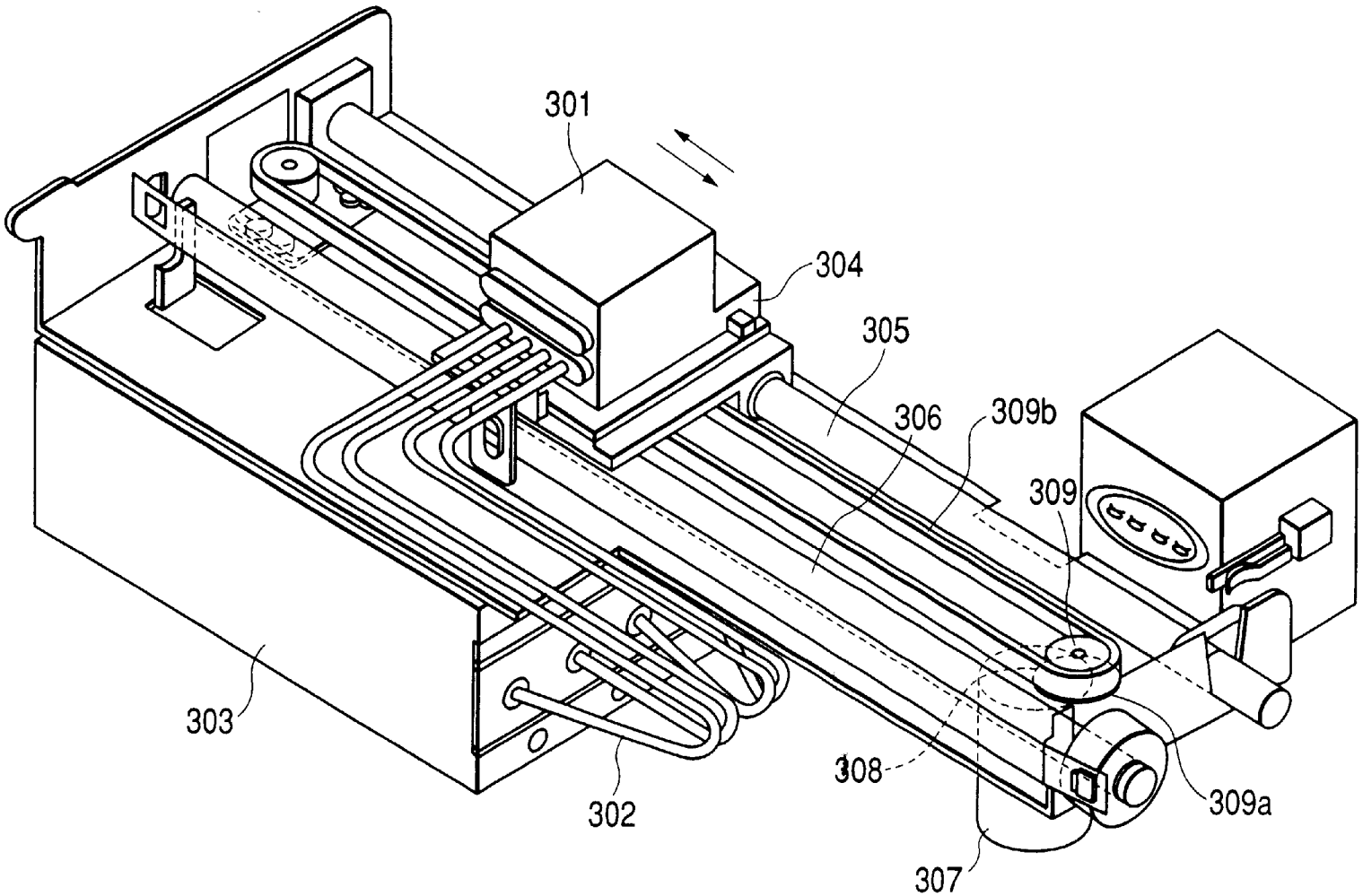
FIG. 1 is a schematic perspective view of an ink jet printer according to the first embodiment of the present invention.
Figure 2:
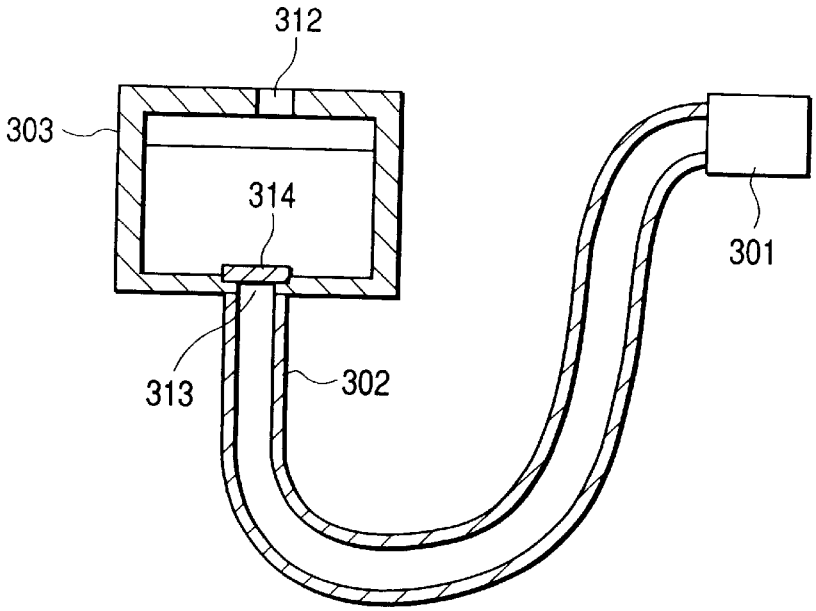
FIG. 2 is a schematic sectional view of a recording liquid feed device used in the ink jet printer.

FIG. 1 is a schematic perspective view of a serial scan type ink jet printer according to the first embodiment and FIG. 2 is a schematic sectional view of a recording liquid feed device portion used in the ink jet printer.

As shown in FIG. 1, the ink jet printer is provided with a carriage 304 supported reciprocatably on two parallel guide shafts 305 and 306 and an ink jet head 301 disposed on the carriage 304 and adapted to eject ink (recording liquid) for adhesion to a recording medium to effect recording. A timing belt 309*b* entrained on two pulleys 309 is connected to the carriage 304. One pulley 309 is provided with a gear portion 309*a* which is in mesh with a pinion gear 308, the pinion gear 308 being mounted on a rotary shaft of a motor 307 which generates a drive force for moving the carriage 304.

Upon turning ON of the motor 307, an output of the motor rotary shaft is transmitted to the associated pulley 309 via the pinion gear 308 and the gear portion 309*a* of the pulley, causing the pulley to rotate. This rotation of the pulley is transmitted to the carriage 304 via the timing belt 309*b*. In this way the carriage 304 is reciprocated in the directions of arrows in FIG. 1 along the guide shafts 305 and 306 according to rotational directions of the pulley 309.

Image recording is performed in the following manner.

The carriage 304 is reciprocated along the guide shafts 305 and 306 and a recording medium (not shown) is moved in a direction perpendicular to the guide shafts, thereby causing the ink jet head 301 to be moved to a position opposed to a desired recording position on the recording medium. Then, the ink jet head 301 is operated to eject ink so that the ink is adhered to the desired recording position on the recording medium.

An ink cartridge (recording liquid container) 303, in which ink tanks for holding inks to be fed to the ink jet head 301 are incorporated, is disposed at a position away from the ink jet head, ink feed tubes (recording liquid feed paths) 302 are laid between the ink cartridge 303 and the ink jet head 301. The ink cartridge 303 contains four ink tanks which hold four inks respectively, and the ink jet head 301 has ink jet head elements corresponding respectively to the four colors. The four feed pipes 302 are provided corresponding to four colors of ink. The inks stored in the ink tanks are fed respectively to the corresponding head elements in the ink jet head 301 through the feed tubes 302.

A recording liquid feed device for feeding inks to the ink jet head 301 is constituted by the ink cartridge 303 and the feed pipes 302. As shown in FIG. 2, inks are contained directly within the ink cartridge 303. In the ink cartridge 303 are formed atmosphere communication ports 312 for introducing the atmosphere into the ink cartridge 303, as well as ink feed ports 313, with a filter 304 being disposed in each of the feed ports 313. In this embodiment, ink is fed to each ink jet head 301 by utilizing a head difference. The ink jet head 301 is disposed at a position higher than the ink cartridge 303 and ink is fed thereto under a predetermined negative pressure condition by utilizing a head difference.

As each feed tube 302 there is used a polyethylene (PE) tube, and polypropylene (PP) is used as the material of each filter 308.

In this embodiment, an inner surface of each feed tube 302 is rendered hydrophilic. A description will be given below about a method for hydrophilizing the inner surface of the polyethylene tube used as the feed pipe 302.

First, a hydrophilizing solution having a composition shown in Table 1 below was prepared.

[Table 1]

TABLE 1

Composition of the hydrophilizing solution

| Component | Amount (wt %) |
|---|---|
| (Polyoxyalkylene)-poly(dimethylsiloxane) | 4.0 |
| Sulfuric acid | 0.5 |
| Isopropyl alcohol | 95.5 |

A polymer solution was prepared using isopropyl alcohol as an organic solvent superior in its dissolving power for a (polyoxyalkylene)-poly(dimethylsiloxane) as a high-molecular compound. More specifically, sulfuric acid as an inorganic acid was added to isopropyl alcohol in such an amount as to give a concentrated sulfuric acid proportion in the final solution of 0.5 wt %, followed by intimate mixing. Then, a (polyoxyalkylene)-poly(dimethylsiloxane) was added in such an amount as to give a proportion thereof in the final solution of 4.0 wt % and was then allowed to dissolve and mix homogeneously, to prepare the above hydrophilizing solution. The (polyoxyalkylene)-poly (dimethylsiloxane) used has a structure with one methyl group replacing the (polyoxyalkylene) group in a main repeating unit of poly(dimethylsilokane) represented by the following general formula (1):

[General formula 1]

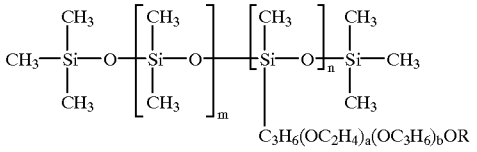

where m and n are positive integers, a and b are also positive integers, and R is an alkyl group or hydrogen.

A commercially available compound (trade name: Silwet L-7002, manufactured by Nippon Unicar Co. Ltd.) was used. The bracketed portion in the above general formula stands for a hydrophilic group, which is the second group (a functional group) explained in FIG. 1, corresponding to the portion indicated at 1-2 in FIG. 33.

In the above hydrophilizing solution there also are dissolved a small amount of water molecules in addition to sulfuric acid molecules in association with the concentrated sulfuric acid.

Using the hydrophilizing solution prepared above, the inner surface of the feed tube 302 was subjected to a hydrophilization treatment. A small amount of the solution was charged into the feed tube to wet the inner surface of the tube. After a uniform wet surface was obtained, a surplus solution was withdrawn from the feed tube 302 to the exterior. The feed tube thus wet uniformly with a film of the solution was dried in a 60° C. oven for 1 hour. In this way the feed tube 302 was rendered hydrophilic.

COMPARATIVE EXAMPLES 1 to 3

To check the effect of the above hydrophilization treatment there were prepared solutions of the following three compositions, which were then each applied to an inner wall surface of a PP (polypropylene) container.

(1) Solution as Comparative Example 1

In the hydrophilizing solution composition shown in the above Table 1, only isopropyl alcohol and sulfuric acid were mixed together. Thus, this solution does not contain a (polyoxyalkylene)-poly(dimethylsiloxane) that is used in the formation of a polymer film intended in the present invention.

(2) Solution as Comparative Example 2

In the solution composition shown in the above Table 1, only isopropyl alcohol and (polyoxyalkylene)-poly (dimethylsiloxane) were mixed together. Thus, a concentrated sulfuric acid is not added to this solution, which solution does not contain sulfuric acid and a small amount of water molecules associated therewith.

(3) Solution as Comparative Example 3

The solution composition shown in the above Table 1 was used except that hexane as a poor solvent for (polyoxyalkylene)-poly(dimethylsiloxane) was used in place of isopropyl alcohol.

Each of the solutions thus prepared as Comparative Examples 1 to 3 was charged in a small amount into a tube to wet an inner surface of the tube. Thereafter, the container used was turned upside down and was shaken, allowing a surplus solution to be withdrawn to the exterior of the container. The tube with the wet inner surface was then dried in a 60° C. oven for 1 hour. As a control there was used an untreated tube.

The tubes thus treated were then checked for a desired surface condition, the results of which are as follows.

a) Method of the hydrophilicity evaluation on tube

The inner surfaces of the four tubes treated respectively with the solution of the composition shown in Table 1 and the solutions as Comparative Examples 1 to 3 and the inner surface of the untreated tube as a control were rinsed with pure water. After removal of the rinsing water used, pure water was newly poured into the thus-rinsed tubes and the tubes were shaken lightly. At this time, an adhered condition of pure water to the tube wall surface was checked visually for each of the tubes.

b) Results of the hydrophilicity evaluation on tube

With the untreated control tube as a reference, the wall surface of the tube which had been subjected to a hydrophilization treatment with the solution of the composition shown in Table 1 was checked and found to be wet with pure water. In contrast therewith, as to the tubes treated with the solutions as Comparative Examples 1 to 3, pure water was observed to move as droplets and the tubes were not wet at all and clearly proved to be hydrophobic like the untreated control tubes.

It is seen that although (polyoxyalkylene)-poly (dimethylsiloxane) is contained in the solutions as Comparative Examples 2 and 3, adsorption thereof onto the tube surface is not performed effectively and that therefore the (polyoxyalkylene)-poly(dimethylsiloxane) was washed off upon rinsing of the container with pure water after the treatment and just before evaluation.

On the other hand, as to the treated tube using the solution of the composition shown in Table 1, even after rinsing the treated tube with pure water, the tube was found to be wet with pure water and thus it is seen that the (polyoxyalkylene)-poly(dimethylsiloxane) used was firmly adsorbed onto the tube inner surface and that the adsorption was performed effectively.

A look at the above results of evaluation clearly shows that a hydrophilization treatment for the surface of a plastic tube is performed effectively by applying thereto a solution containing a polyalkylsiloxane having a polyalkylene oxide chain, an acid and an alcohol and by subsequent drying. It is also seen that a desired orientation and adhesion of a high-molecular polyalkylsiloxane to the tube inner surface are attained by conducting the treatment in the presence of an acid and an alcohol. Further, coupled with washing a plastic surface with acid and alcohol to afford a clean plastic surface, it became clear that the methyl group moiety of an alkylsiloxane structure as a repeating unit in a polyalkylsiloxane having a plastic surface and polyalkylene oxide chain, which exhibits a hydrophobic nature, was oriented on the plastic surface and that for this reason the entire adhesive force was improved.

Besides, by dissolving the polyalkylsiloxane having a polyalkylene oxide chain in an alcohol which is a good solvent for the polyalkylsiloxane, it is possible to disperse the polyalkylsiloxane having a polyalkylene oxide chain uniformly on a plastic surface and allow it adhere to the plastic surface effectively. In case of mere application and drying of a surfactant having a hydrophilic group, an initial hydrophilic nature is obtained, but rinsing with pure water will immediately results in the surfactant being dissolved in water, with loss of the imparted hydrophilic nature.

Thus, the above hydrophilization treatment can be carried out uniformly and continuously. According to this treating method, moreover, a hydrophilized surface 316 can be formed on the inner surface of the feed tube 302 by a molecular level of a thin polymer film which scarcely causes any change in inside diameter. The hydrophilized surface 316 also exhibits air permeability and elution preventing effect. By such a hydrophilization treatment it is possible to improve the fluidity of the recording liquid within the feed tube 302. As to the principle of this surface modification (hydrophilization), it will be described later.

Figure 3A:
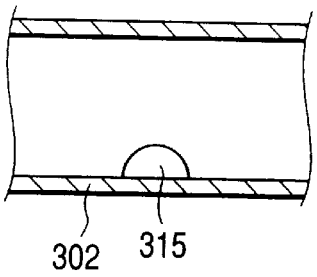

If the inner surface of the feed tube 302 is not rendered hydrophilic, the air which has passed through the wall of the feed tube 302 is apt to adhere to the tube inner surface and forms a bubble 315 on the tube inner surface, as shown in FIG. 3A. The bubble 315 thus adhered to the inner surface of the feed tube 302 is difficult to be drifted even if there occurs a slight ink flow within the feed tube. With the bubble 315 thus adhered to the tube inner surface, the ink does not contact the bubble-adhered portion of the tube wall, so that the osmotic pressure of the ink becomes lower. Consequently, the entry of air into the feed tube 302 from the bubble 315-adhered portion is accelerated.

Figure 3B:
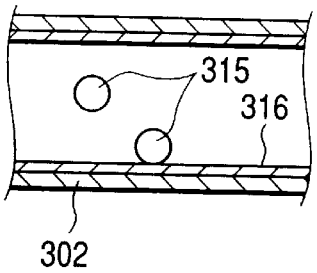

On the other hand, in the feed tube 302 whose inner surface has been rendered hydrophilic as the hydrophilized surface 316, as shown in FIG. 3B, even if air which has passed through the wall of the feed tube 302 adheres to the tube inner surface and forms a bubble 315, the ink is conducted along the hydrophilized surface 316 at the tube portion to which the bubble 315 is adhered, so that the area of bubble-adhered surface decreases and eventually the bubble 315 leaves the tube inner surface and floats. Consequently, the bubble 315 is carried away by the ink easily at the time of feeding ink. Besides, since the ink is conducted along the hydrophilized surface 316 at the bubble-adhered portion of the feed tube 302, the entry of air into the feed tube 302 from the bubble-adhered portion can be prevented under the osmotic pressure of the ink.

Thus, in the recording liquid feed device of this embodiment, since the inner surface of the feed tube 302 is rendered hydrophilic, it is possible to reduce the staying of the bubble 315 within the feed tube 302 and hence possible to prevent the ink flow from being obstructed by the bubble 315, thus permitting the ink to be conducted efficiently. Moreover, the ink can be fed at a high flow rate because it is possible to improve the ink fluidity. Even if the bubble 315 is formed in the tube interior, the continuity of the tube can be recovered easily by recovery means such as, for example, suction or the application of pressure. It is difficult to use all of the ink held by the absorber 310, but in the recording liquid feed device of this embodiment it is possible to feed ink efficiently, so it is possible to increase the usage of the ink held by the absorber 310. Further, since the bubbles 315 which adhere directly to the feed tube decrease, it is possible to prevent the occurrence of a gas inducing state from the exterior of the feed tube 302 to make it difficult for the bubble 315 to grow.

The surface of the filter 308 may be rendered hydrophilic by the same method as that for the inner surface of the feed tube 302. By using the filter 308 having the thus-hydrophilized surface, the ink held by the absorber 304 can be conducted efficiently to the filter 308 portion and can be conducted smoothly to the feed tube 302. Moreover, by thus making the surface of the filter 308 hydrophilic, it is possible to decrease a pressure loss caused by the filter.

Heretofore, as the filter 308 there has been used a filter of a shape capable of preventing its flow resistance from becoming too high, but the use of the surface-hydrophilized filter 308 permits the use of various filter shapes such as using a filter 308 of a finer mesh, thus making it possible to improve the filter function.

(Second Embodiment)

The second embodiment of the present invention will now be described with reference to FIG. 4, which is a schematic sectional view of a recording liquid feed system according to this second embodiment.

Figure 4:
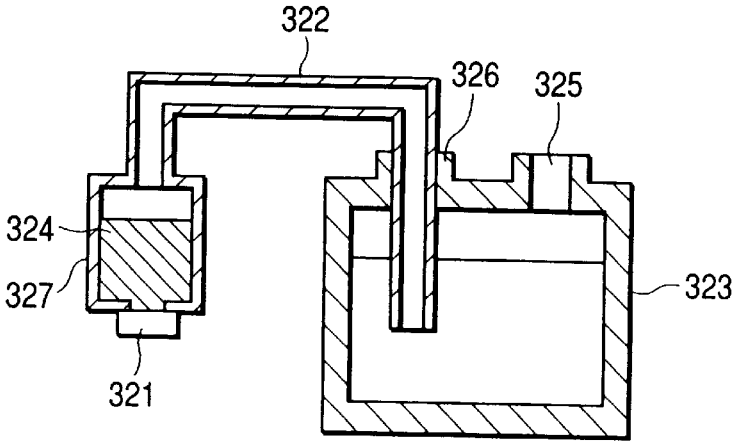
FIG. 4 is a schematic sectional view of a recording liquid feed device according to the second embodiment of the present invention.

As shown in FIG. 4, this recording liquid feed system is provided with an ink cartridge (a second container) 323, an ink holding chamber 327 integral with an ink jet head 321, the ink holding chamber 327 containing an absorber 324 which holds ink temporarily with a capillary force, and a feed tube 322 for conducting ink from the ink cartridge 323 into the ink holding chamber 327. In the ink cartridge 323 are formed an atmosphere communication port 325 for introducing the atmosphere and a feed port 326 for the feed of ink. The feed tube 322 is inserted into the ink cartridge 323 through the feed port 326.

In the recording liquid feed device of this embodiment, the feed ink from the ink cartridge 323 to the absorber 324 is performed, for example, by detecting a residual amount of ink held in the absorber 324 with use of an electric probe (not shown) or the like and by turning ON a pump (not shown) if the detected signal indicates a shortage of ink held by the absorber 324.

An inner surface of the feed pipe 322 is rendered hydrophilic like that in the first embodiment. As the absorber 324 is used a negative pressure generating member constituted by a PP fibrous absorber. In the PP fibrous absorber, the surfaces of its constituent fibers are rendered hydrophilic, which hydrophilization is preferably carried out on the basis of the same principle (to be described later) as that described in the first embodiment.

In this embodiment, since the fiber surfaces in the PP fibrous absorber 324 are rendered hydrophilic and are therefore high in wettability, the ink absorbing speed of the fibrous absorber is high and ink can be absorbed efficiently by the absorber 324. Besides, since the flow resistance during ink movement is low in the fibrous absorber portion, it is possible to conduct ink to the ink jet head 321 efficiently.

Further, since the inner surface of the feed tube 322 is rendered hydrophilic, ink can be conducted efficiently through the feed tube 322 as is the case with the first embodiment.

(Third Embodiment)

Figure 5A:
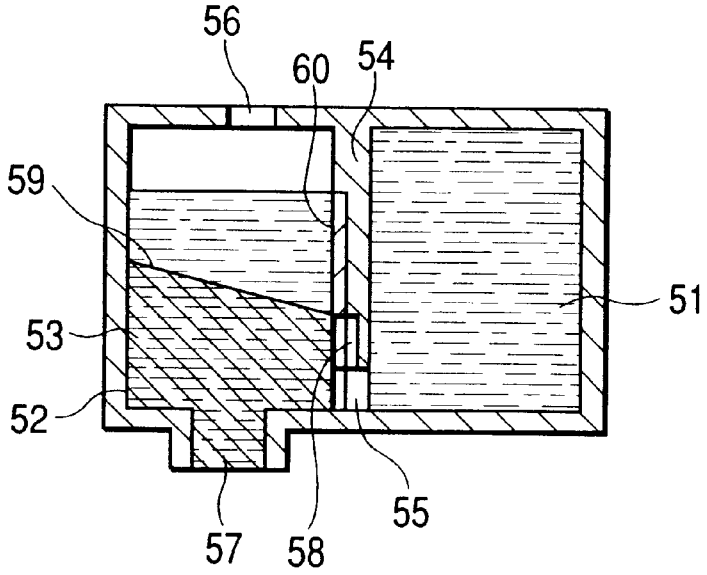
Figure 5B:
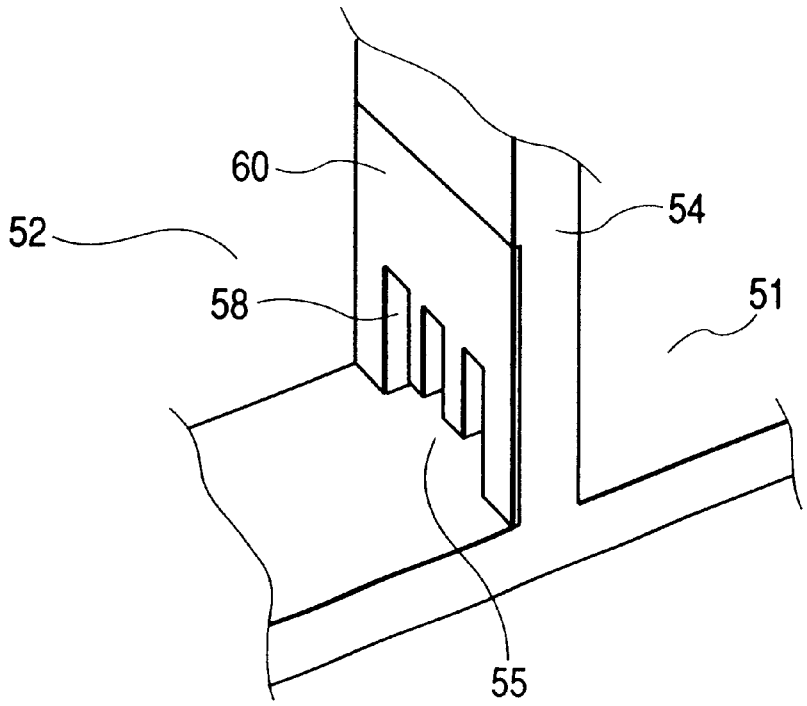

The third embodiment of the present invention will now be described with reference to FIGS. 5A and 5B. FIGS. 5A and 5B are schematic diagrams of an ink cartridge as a constituent of a recording liquid feed device according to this embodiment, in which FIG. 5A is a sectional view and FIG. 5B is a perspective view of a communicating portion 55 and thereabouts.

As shown in FIGS. 5A and 5B, this ink cartridge is provided with a liquid storage chamber 51 with ink stored therein directly and an absorber containing chamber 52 with an absorber 53 received therein which absorber absorbs and holds ink. A partition wall 54 is formed between the liquid storage chamber 51 and the absorber containing chamber 52, and the liquid storage chamber 51 and the absorber containing chamber 52 are separated from each other except a communicating portion 55 which is opened in a lower end of the partition wall 54. In the absorber containing chamber 52 are formed an atmosphere inlet port 56 for introducing the atmosphere and a feed port 57 for ink feed. On the absorber containing chamber 52 side of the partition wall 55 are formed three gas-liquid exchange grooves 58 which extend upward from the communicating portion 55.

The absorber 53 is a negative pressure generating member which generates a negative pressure with a capillary force of a porous or fibrous material. Simultaneously with ink being absorbed into the absorber 53 from the liquid storage chamber 51 through the communicating portion 55, air is conducted into the liquid storage chamber 51 through the gas-liquid exchange grooves 58. By a gas-liquid exchanging operation, ink is fed from the liquid storage chamber 51 into the absorber containing chamber 52. As a result, the ink thus absorbed in the absorber 53 reaches a position near the upper ends of the gas-liquid exchange grooves 58, with a gas-liquid interface 59 being formed in the absorber 53 which interface is a boundary between the ink absorbed portion and the ink unabsorbed portion. Since the ink cartridge being considered is provided with the absorber 53, there accrues a merit such that ink can be fed from the feed port 57 under a substantially constant negative pressure condition. A negative pressure generating member containing a PP fibrous absorber is used as the absorber 53 in this embodiment, and PP is used as the material of the partition wall 54.

In this embodiment, the partition wall 54 has a hydrophilized surface 60 on its side which is in contact with the absorber 53. It is optional whether the formation area of the hydrophilized surface 60 is to cover the whole of the partition wall 54 which faces the absorber containing chamber 52 side or is to cover from the lower portion of the partition wall 54 up to the upper ends of the gas-liquid exchange grooves 58. It is preferable that the hydrophilization be carried out on the basis of the same principle (to be described later) as that shown in the first embodiment.

Since the hydrophilized surface 60 is thus formed on the partition wall 54, ink is conducted to the absorber 53 through the communicating portion 55, and when the gas-liquid interface 59 reaches the upper ends of the gas-liquid exchange grooves 58, part of the ink held by the absorber 53 is conducted to the hydrophilized surface 60 and is held thereon. Consequently, even if a very small gap is present between the partition wall 54 and the absorber 53, an air path is difficult to be formed because the gap is filled with ink. Thus, when the gas-liquid interface 59 reaches the upper ends of the gas-liquid exchange grooves 58, the introduction of air into the liquid storage chamber 51 stops and so does the gas-liquid exchanging operation, that is, the feed of ink from the liquid storage chamber 51 to the absorber containing chamber 52 stops. In this way the gas-liquid interface 59 becomes stable near the upper ends of the gas-liquid exchange grooves 58. Therefore, it is possible to prevent the gas-liquid interface 59 from rising more than necessary or from reaching the upper end of the absorber containing chamber 52, which is caused by formation of an air path between the partition wall 54*a* and the absorber 53 and which would lead to ink leakage.

In the ink cartridge according to this embodiment, as described above, since the contact surface of the partition wall 54 with the absorber 53 is rendered hydrophilic, it is possible to perform a stable gas-liquid exchanging operation and feed ink stably. Further, the gas-liquid exchanging operation can be stabilized even if there is a slight gap between the partition wall 54 and the absorber 53; therefore, it is scarcely required to make management so as to prevent the formation of such a gap and the insertion of the absorber 53 into the absorber containing chamber 52, as well as the management thereof, can be done easily, thus permitting an efficient manufacture.

(Fourth Embodiment)

Figure 6:
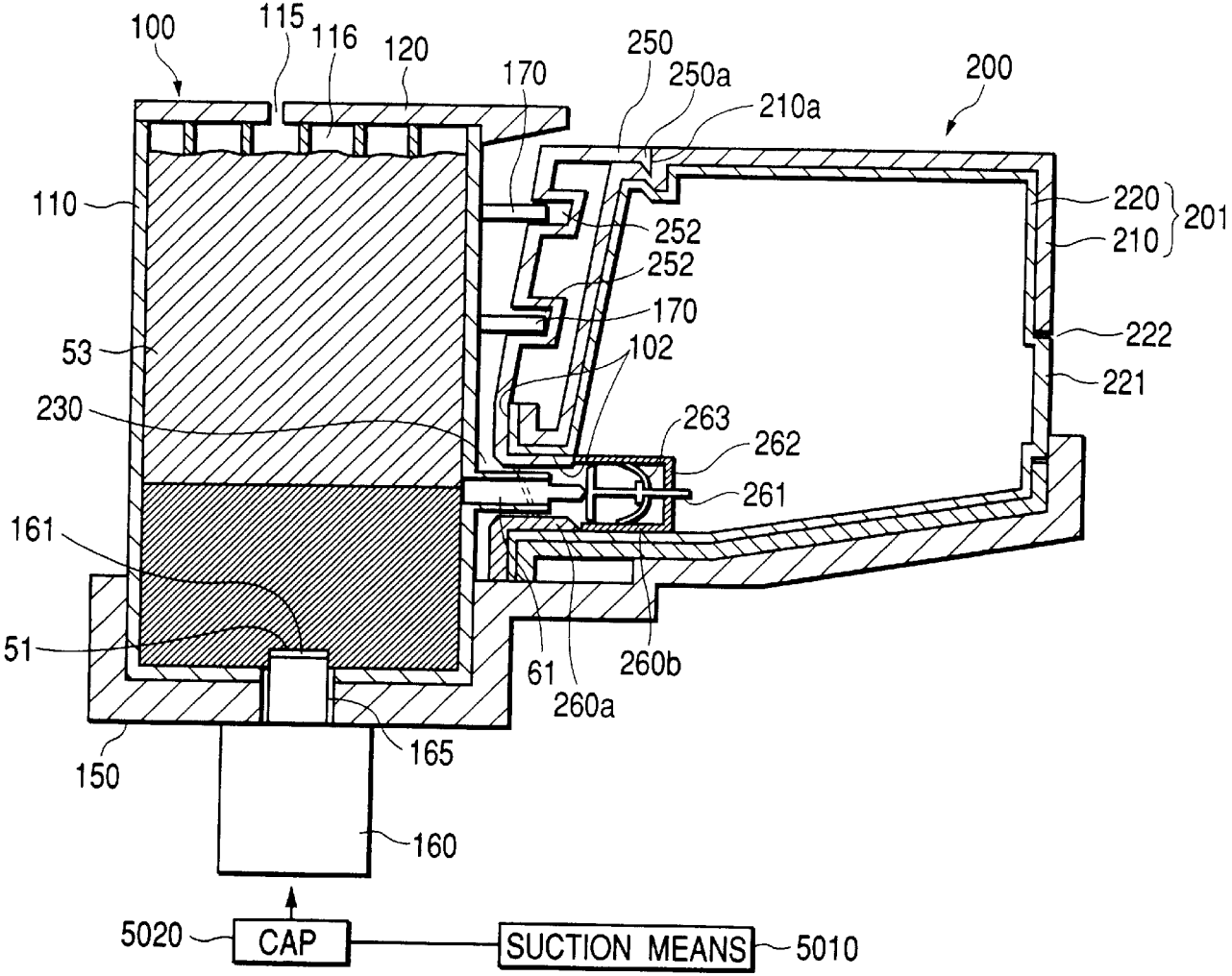
FIG. 6 is a schematic sectional view of an ink jet head cartridge as a constituent of a recording liquid feed device according to the fourth embodiment of the present invention.

As shown in FIG. 6, an ink jet head cartridge containing a recording liquid container according to this embodiment comprises an ink jet head unit 160, a holder 150, a negative pressure control chamber unit 100 containing an absorber containing chamber 52, and an ink tank unit 200 containing a liquid storage chamber 51. The negative pressure control chamber unit 100 is fixed within the holder 150 and the ink jet head unit 160 is fixed to the underside of the negative pressure control chamber unit 100. The negative pressure control chamber unit 100 is made up of a negative pressure control container 110 having an opening formed in an upper surface thereof, a negative pressure control chamber lid 120 attached to the upper surface of the negative pressure control container 110, and an absorber 53 for holding ink in an impregnated state, the absorber 53 being inserted into the negative pressure control container 110.

The ink tank unit 200 is constructed so as to be removable from the holder 150. A joint pipe 180 as a to-be-connected portion is formed in the negative pressure control container 110 on the side facing the ink tank unit 200 and is inserted and connected into a joint port 230 of the ink tank unit 200. The negative pressure control chamber unit 100 and the ink tank unit 200 are constructed to that the ink present within the ink tank unit 200 is fed into the negative pressure control chamber unit 100 through the connection between the joint pipe 180 and the joint port 230. ID members 170 for preventing an erroneous mounting of the ink tank unit 200 are integrally projected from the negative pressure control container 110 on the side facing the ink tank unit 200 and at higher positions than the joint pipe 180.

In the negative pressure control chamber lid 120 is formed an atmosphere communication port 115 for communication between the interior of the negative pressure control container 110 and the outside air, here between the absorber 130 received within the container 110 and the outside air. Within the negative pressure control container 110 and in the vicinity of the atmosphere communication port 115 are formed spaces by ribs projecting from the negative pressure control chamber lid 120 on the side facing the absorber 53, as well as a buffer space 116 constituted by an ink (liquid)-free area in the absorber.

Within the joint port 230 is disposed a valve mechanism, which comprises a first valve frame 260*a*, a second valve frame 260*b*, a valve body 261, a valve lid 262, and an urging member 263. The valve body 261 is supported slidably within the second valve frame 260*b* and is urged toward the first valve frame 260*a* by the urging member 263. When the joint pipe 180 is not inserted into the joint port 230, an edge of the first valve frame 260*a*-side portion of the valve body 261 is pushed by the first valve frame 260*a* by the urging force of the urging member 263, whereby the interior of the ink tank unit 200 is kept air-tight.

When the joint pipe 180 is inserted into the joint port 230 and the valve body 261 is pushed by the joint pipe 180 and moves away from the first valve fame 260*a*, the interior of the joint pipe 180 communicates with the interior of the ink tank unit 200 through an opening formed in a side face of the second valve frame 260*b*. As a result, the interior of the ink tank unit 200 is released from the air-tight condition and the ink present within the ink tank unit 200 passes through the joint port 230 and the joint pipe 180 and is fed into the negative pressure control chamber unit 100. That is, by opening of the valve located within the joint port 230, the interior of the ink containing portion of the ink tank unit 200 in the air tight condition assumes a state of communication only through the aforesaid opening.

The ink tank unit 200 is composed of an ink container 201 and an ID member 250. The ID member is for preventing an erroneous mounting at the time of joining the ink tank unit 200 and the negative pressure control chamber unit 100 with each other. The ID member 250 is formed with the first valve frame 260*a*, and using the first valve frame 260*a* there is formed a valve mechanism for controlling the flow of ink within the joint port 230. This valve mechanism is brought into engagement with the joint pipe 180 in the negative pressure control chamber unit 100 to effect an opening and closing operation. In a front side of the ID member 250 which side faces the negative pressure control chamber unit 100 there are formed ID recesses 252 for preventing an erroneous insertion of the ink tank unit 200.

The ink container 201 is a generally prismatic hollow container which has a negative pressure generating function and which is composed of a housing 210 and an inner bag 220. The housing 210 and the inner bag 220 can be separated from each other. The inner bag 220 is flexible and can be deformed with discharge of ink contained within the bag. The inner bag 220 has a pinch-off portion (weld portion) 221, whereby the inner bag 220 is supported in an engaged form with the housing 210. Further, an outside air communication port 222 is formed in the housing 210 in the vicinity of the pinch-off portion 221 so that the outside air can be introduced between the inner bag 220 and the housing 210 through the outside air communication port 222.

The ID member 250 is joined to both housing 210 of the ink container 201 and the inner bag 220. In this case, the ID member 250 is joined to the inner bag 220 by welding between a sealing surface 102 of the inner bag at an ink outlet portion of the ink container 201 and the corresponding surface of the ID member 250 at the joint port 230 portion, whereby the feed port portion of the ink container 201 is sealed completely, so that the leakage of ink from the sealed portion between the ID member 250 and the ink container 201 is prevented at the time of mounting or removal of the ink tank unit 200.

When the housing 210 and the ID member 250 are to be joined together, an engaging portion 210*a* formed on an upper surface of the housing 210 and a click portion 250*a* formed at an upper portion of the ID member 250 are at least brought into engagement with each other, whereby the ID member is substantially fixed to the ink container 201.

As to the ink jet head 160, recovery to the normal state can be done by ejecting ink forcibly from an ink ejection orifice closed with a cap or by sucking ink by suction means 5010 in a closed state of the ink ejection orifice with a cap 5020.

In the ink cartridge according to this embodiment, as described above, the liquid storage chamber 51 and the absorber containing chamber 52 are provided separately from each other and both are in communication with each other through the joint pipe 160, through which pipe there is performed gas-liquid exchange.

The following description is now provided about the movement of ink between the ink tank unit 200 and the negative pressure control chamber unit 100.

Figure 9A:
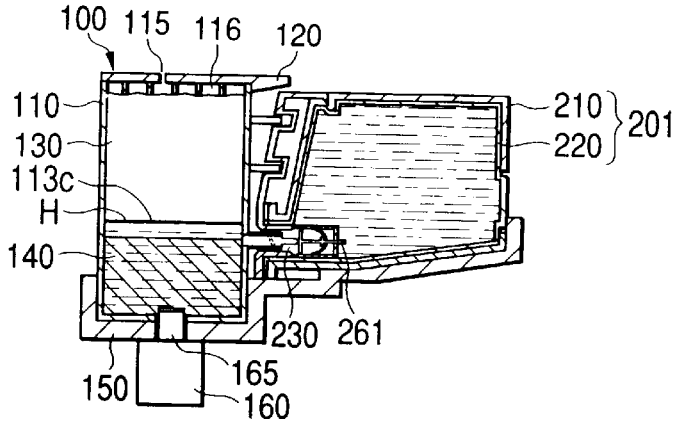
FIGS. 9A, 9B, 9C and 9D are diagrams showing examples of moving states of ink in the ink jet head cartridge shown in FIG. 6.
Figure 9B:
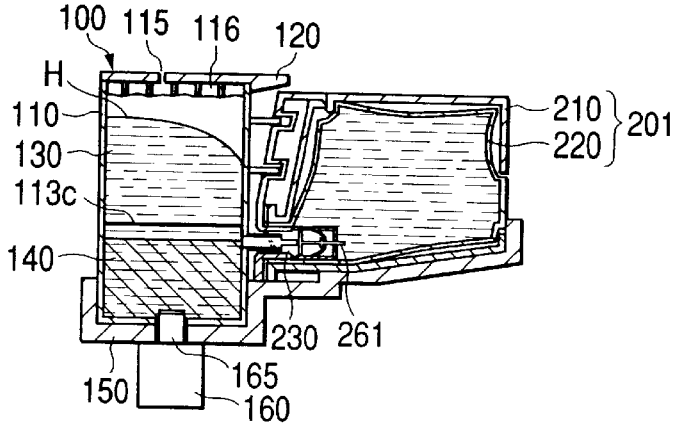

When the ink tank unit 200 and the negative pressure control chamber unit 100 are joined together as in FIG. 9A, the ink present within the ink container 201 moves into the negative pressure control chamber unit 100 until the internal pressure of the negative pressure control chamber unit 100 and that of the ink container 201 become equal to each other as in FIG. 9B (this state is designated an initial use state).

When the consumption of ink by the ink jet head unit 160 is started, the ink present within the inner bag 220 and the ink held in the absorber 53 are consumed while taking balance in a direction in which the values of static negative pressures generated from both the interior of the inner bag 220 and the absorber 53 increase.

Figure 9C:
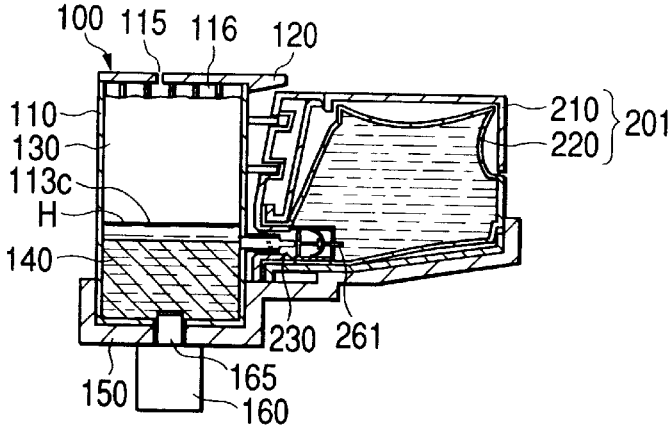
Figure 9D:
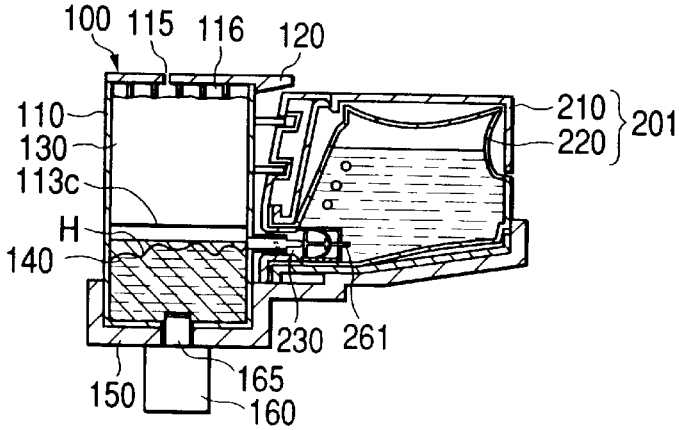

When the amount of ink present within the negative pressure control chamber unit 100 decreases from the state of FIG. 9C and the joint pipe comes into communication with the atmosphere, gas is introduced into the inner bag 220 immediately and instead the ink present within the inner bag 220 moves into the negative pressure chamber unit 100. Thus, the absorber 53 maintains a nearly constant negative pressure against the discharge of ink while retaining the gas-liquid interface. When all of the ink present within the inner bag 220 has moved into the negative pressure control chamber unit 100 through such a gas-liquid exchange condition, the ink remaining within the negative pressure control chamber unit 100 is consumed.

Figure 7B:
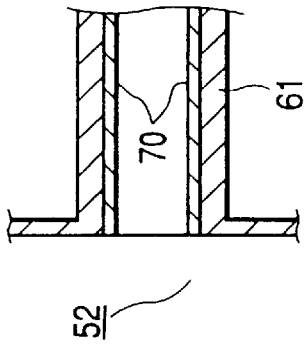

In this embodiment, an inner surface of a joint pipe 61 has been subjected to a hydrophilization treatment to form a hydrophilized surface 70 as in FIG. 7B. It is preferable that the hydrophilization treatment be performed on the basis of the same principle (to be described later) as that referred to in the first embodiment.

Thus, in the ink cartridge according to this embodiment, since the inner surface of the joint pipe 61 is rendered hydrophilic, the ink held in the liquid storage chamber 51 formed within the inner bag 220 of the ink container 201 is conducted into the joint pipe 61 along the hydrophilized surface 70 and hence can be conducted efficiently from the liquid storage chamber 51 into the absorber containing chamber 52. Besides, even if the joint pipe 61 is somewhat inclined upward toward the absorber containing chamber 52, it is possible to feed ink smoothly without causing ink exhaustion.

Figure 8A:
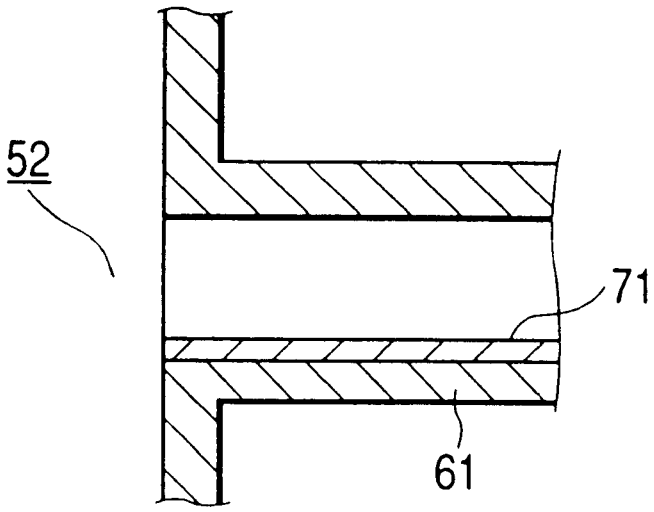
FIGS. 8A and 8B are sectional views showing another examples of hydrophilization for the joint pipe 61 portion of the ink cartridge shown in FIG. 6.

In the ink cartridge according to this embodiment there is performed gas-liquid exchange in such a manner that air is introduced from the absorber containing chamber 52 into the liquid storage chamber 51 through the joint pipe 61 simultaneously with the feed of ink from the liquid storage chamber 51 into the absorber containing chamber 52 through the joint pipe 61. In this connection, if only a lower surface portion of the joint pipe 61 is rendered hydrophilic to form a hydrophilized surface 71 as in FIG. 8A, ink is passed along the lower portion of the joint pipe 61 while air is passed along the upper portion of the joint pipe 61, whereby it is made possible to effect a stabler gas-liquid exchanging operation.

Figure 8B:
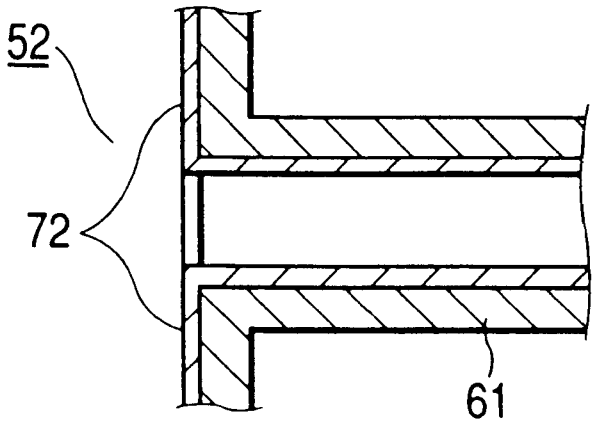

As shown in FIG. 8B, if the contact surface of the absorber containing chamber 52 with the absorber 53 is rendered hydrophilic on the side to which the joint pipe 61 is connected, to form a hydrophilized surface 72, it is possible to prevent air from being conducted to the joint pipe 61 through the gap between the inner surface of the absorber containing chamber 52 and the absorber 53, allowing the gas-liquid interface 59 to become stable near the upper end of the joint pipe 61. Thus, it is possible to prevent the gas-liquid interface 59 from rising more than necessary or from reaching the upper end of the absorber containing chamber 52 which would cause ink leakage. In this way the gas-liquid exchanging operation can be stabilized to ensure a stable feed of ink.

Figure 11A:
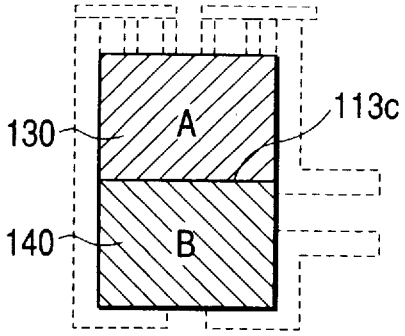
FIGS. 11A, 11B, 11C, 11D, 11E and 11F are diagrams showing modification examples of hydrophilization for an absorber, an absorber containing chamber, and a joint pipe in the jet head cartridge shown in FIG. 6.
Figure 11D:
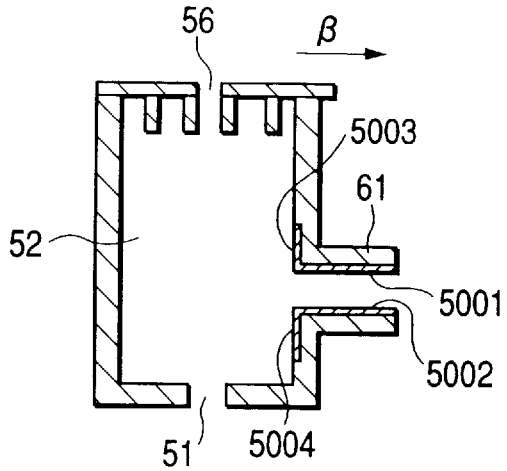

FIG. 11D shows a state in which a whole area of the inner surface of the joint pipe 61 (an area covering both upper and lower hydrophilized surface 5001, 5002 in the sectional view), a surface 5003 of the inner wall of the absorber containing chamber located above the joint pipe, including gas-liquid exchange grooves (not shown), and a surface 5004 of the inner wall of the absorber containing chamber located below the joint pipe, are rendered hydrophilic.

For preventing the illustration from becoming complicated, the absorber contained in the absorber containing chamber 52 is not shown.

Figure 11B:
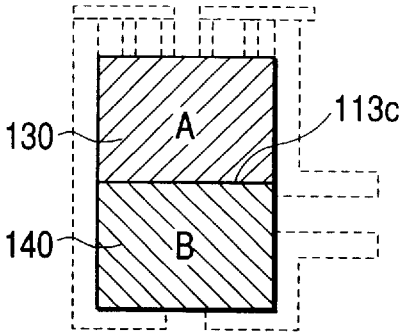
Figure 11E:
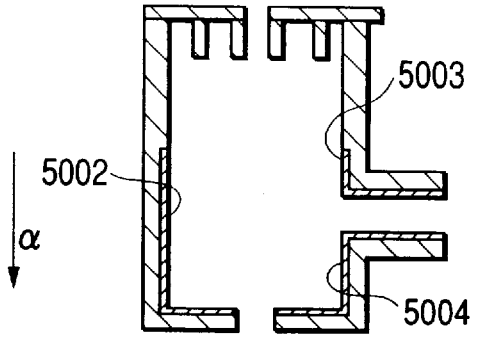

FIG. 11E shows a modification of FIG. 1D, in which four surfaces and a bottom surface of the inner wall of the absorber containing chamber are rendered hydrophilic up to about the same height as the upper end of the hydrophilized surface 503 shown in FIG. 11D, in addition to the whole area of the inner surface of the joint pipe 61.

In FIG. 11E, like FIG. 11D, the absorber contained in the absorber containing chamber 52 is not shown for preventing the illustration from becoming complicated.

Figure 11C:
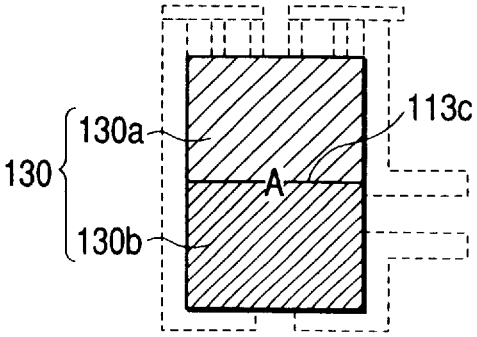
Figure 11F:
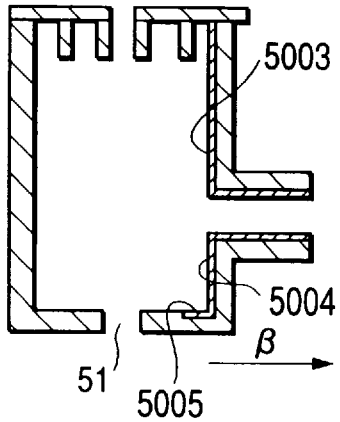

FIG. 11F is a further modification of FIG. 11D, in which the whole area of one inner wall surface of the absorber containing chamber 52 where the opening of the joint pipe 61 and gas-liquid exchange grooves (not shown) are formed, is rendered hydrophilic in addition to the whole inner surface area of the joint pipe 61. Further, a hydrophilized surface 5005 extending toward the ink feed port 51 may be formed on the bottom side.

Also in FIGS. 11D and 11F, the absorber contained in the absorber containing chamber 52 is not shown for avoiding a complicated illustration.

As shown in FIG. 11D, since the hydrophilized surface 5003 is formed on the inner surface of the joint pipe 61 which provides a communication between the liquid container and the absorber containing chamber and on the inner wall surface portion continuous to the joint pipe inner surface and extending up to the position above the groove including the gas-liquid exchanges grooves (not shown), even if a very small gap is present between the absorber and the inner wall surface portion positioned above the gas-liquid exchange grooves, the gap is closed with ink which has entered the absorber containing chamber from the liquid storage chamber 51 through the joint pipe 61, and thus there is no fear of careless formation of an air path.

Besides, since the hydrophilized surface 5004 is formed continuously to and below the inner surface of the joint pipe 61, even if a very small gap is present between the absorber and the lower inner wall surface portion, it is not likely that the air which has moved down through the gas-liquid exchange grooves will further move along the inner wall surface together with the ink flowing toward the ink feed port 51 from the joint pipe 61 particularly when the ink is fed in a large flow rate.

FIG. 11E shows a modification of FIG. 11D, in which since both bottom surface and inner wall side faces surrounding the ink feed port 131 are rendered hydrophilic, not only the same effect as in the example of FIG. 11D is obtained, but also in the ink path from the joint pipe 61 toward the ink feed port 51 within the absorber containing chamber the flow of ink near the wall surface which substantially does not contribute to the feed of ink can be made smooth, with the result that it is possible to expect a decrease of flow resistance.

FIG. 11F shows a modification in which a minimum required area of hydrophilization is used for obtaining the effect of FIG. 11E. In comparison with FIG. 11D or 11E, the whole area of one inner wall surface in the absorber containing chamber is hydrophilized in addition to the joint pipe inner surface, there accrues an advantage that the amount of the hydrophilizing solution to be adhered can be controlled more easily as compared with the example of FIG. 11D in which it is a partial surface portion that is treated and the example of FIG. 11E in which it is plural surfaces that are treated.

FIGS. 11A to 11C show modifications of hydrophilization for the absorber contained in the absorber containing chamber 52, which modifications may be combined with FIGS. 11D to 11F which are modifications of hydrophilization for the absorber containing chamber 52 described above to get a desired effect.

More specifically, in FIG. 11A, a whole area covering both upper absorber 130 and lower absorber 140 is a hydrophilization area, which absorbers are constituted by a polyolefin fibrous ink absorber as a negative pressure generating member. In FIG. 11B, only one absorber 130 is contained in the negative pressure control container 110 and the whole area substantially below a horizontal interface 113*c* is rendered hydrophilic. In both examples, the interface 113*c* between the absorbers 130 and 140 is positioned near and above the joint pipe 180 at a posture assumed in use.

FIG. 11C shows an example in which only one absorber 130 is contained within the negative pressure control container 110 and the whole area substantially below a horizontal interface 130*c* is rendered hydrophilic. The interface 130*c*, which is a hydrophilization-nonhydrophilization interface, is positioned near and above and the joint pipe 180 at a posture assumed in use.

The examples shown in FIGS. 11A to 11C can be substituted as desired for the negative pressure generating member (absorber) used in the above embodiment. In FIG. 11A, when the absorbers 130 and 140 as fibrous absorbers are viewed as a whole of a fibrous member, the absorber 140 is located on the ink feed port side and the absorber 130 is on the atmosphere communication port side. It can be regarded that a partial hydrophilization treatment is applied to the whole of the absorber 140.

In all of FIGS. 11A to 11C, since the hydrophilized area is located on the feed port side for the action of 80° or more in terms of a contact angle of the polyolefin fibrous member relative to water, the ink retaining property for a water-based ink and the liquid level in negative pressure generation can be made uniform at least within the absorber 140, so that the stabilization of a negative pressure can be attained. At the same time, in the case where hydrophilization is performed with the foregoing treating solution, it is easy to keep the liquid level horizontal during suspension or stop of ink jet recording while ensuring an excellent ink feedability in a decreased flow resistance attained by a hydrophilic group. Thus, the ink retention and distribution are made extremely uniform and therefore it is possible to ensure a stable negative pressure at once. Particularly, in FIG. 11C, the fibrous member can be constituted as a single member, with consequent reduction of cost as compared with the use of two members, and there can be obtained an effect based on a hydrophilic-hydrophobic interface although it may be impossible to attain the same function as the aforesaid function based on the interface between two members.

In FIG. 11B, the absorber 130 is also hydrophilized, in which a satisfactory ink absorbing effect is obtained even against some pressure change while ensuring the interfacial effect between the absorbers 130 and 140, so that the cause itself of ink leakage can be solved fundamentally.

Since in all of FIGS. 11A to 11C the ink receiving surfaces for the ink fed through the joint pipe 61 are rendered hydrophilic, not only the fed ink but also the ink from the ink container connected removably to the joint pipe can be surely absorbed. It goes without saying that all of the above descriptions related to gas-liquid exchange and fiber direction are applicable to all of FIGS. 11A to 11C.

Figure 7A:
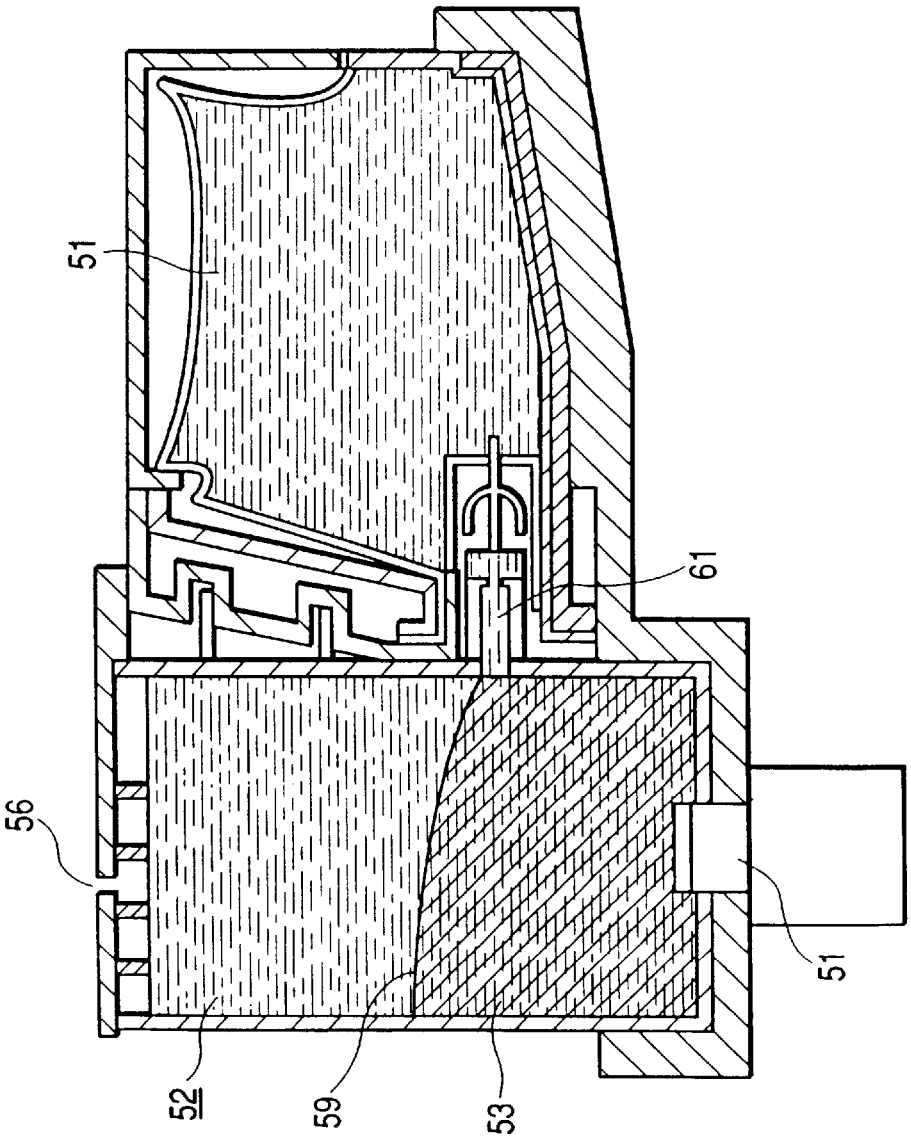

The examples shown in FIGS. 11A to 11F cover not only the effect of the embodiment illustrated in FIGS. 7A and 7B but also all of the effects attained by the partial hydrophilization according to the present invention.

The mode shown in FIG. 11E can be obtained easily by inserting the absorber containing chamber in the direction of arrow "α" in the figure into a liquid reservoir containing a treating solution, allowing it to be dipped into the solution, and subsequent drying as described above. Likewise, the mode shown in FIG. 11F can be obtained by dipping the absorber containing chamber in the same direction (arrow "β" direction) into the liquid reservoir. As to FIG. 11D, the inserting direction may be same ("β" direction) as in FIG. 11F, but as to the unhydrophilized area, the area may be masked before dipping into the treating solution. Thus, in all of those modes, the interior of the absorber containing chamber can be rendered hydrophilic easily by such methods as mentioned above.

Figure 10:
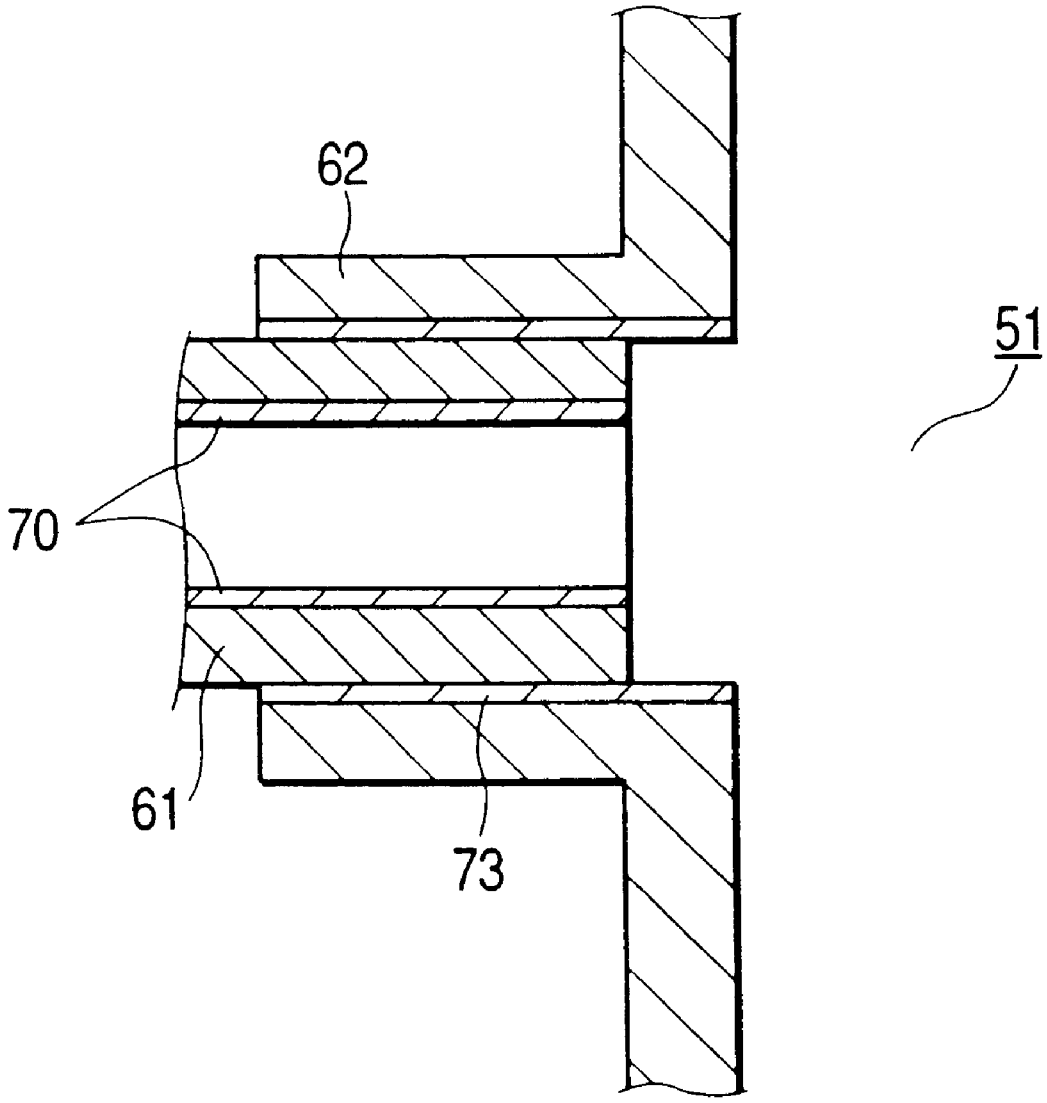
FIG. 10 is a sectional view showing an example of water-repellant treatment for a connection port 62 portion of the ink jet head cartridge shown in FIG. 6.

As shown in FIG. 10, an inner surface of a connection port 62 of the liquid storage chamber 51 which is connected to the joint pipe 61 may be subjected to a water repelling treatment to form a water-repellent surface 73. By so doing, at the time of replacing the liquid storage chamber 51 constituted as a separate member from the absorber containing chamber 52, it is possible to prevent ink from moving into the connection port 62 of the liquid storage chamber 51. Even if a small amount of ink is conducted from the liquid storage chamber 51 into the connection port 62, it is possible to conduct the ink from the connection port 62 into the joint pipe 61 by performing the replacing work slowly. That is, it is possible to prevent unnecessary ink from remaining in the connection port 62. Also as to the water-repelling treatment it is preferable that the treatment be carried out on the basis of the same principle (to be described later) as that mentioned in the first embodiment.

A detailed description will be given below about the construction of the fifth embodiment which brings about a further effect by performing a further hydrophilization in addition to the above hydrophilization for the joint pipe or for the surface of contact with the absorber on the side where the joint pipe is connected.

(Fifth Embodiment)

Figure 12:
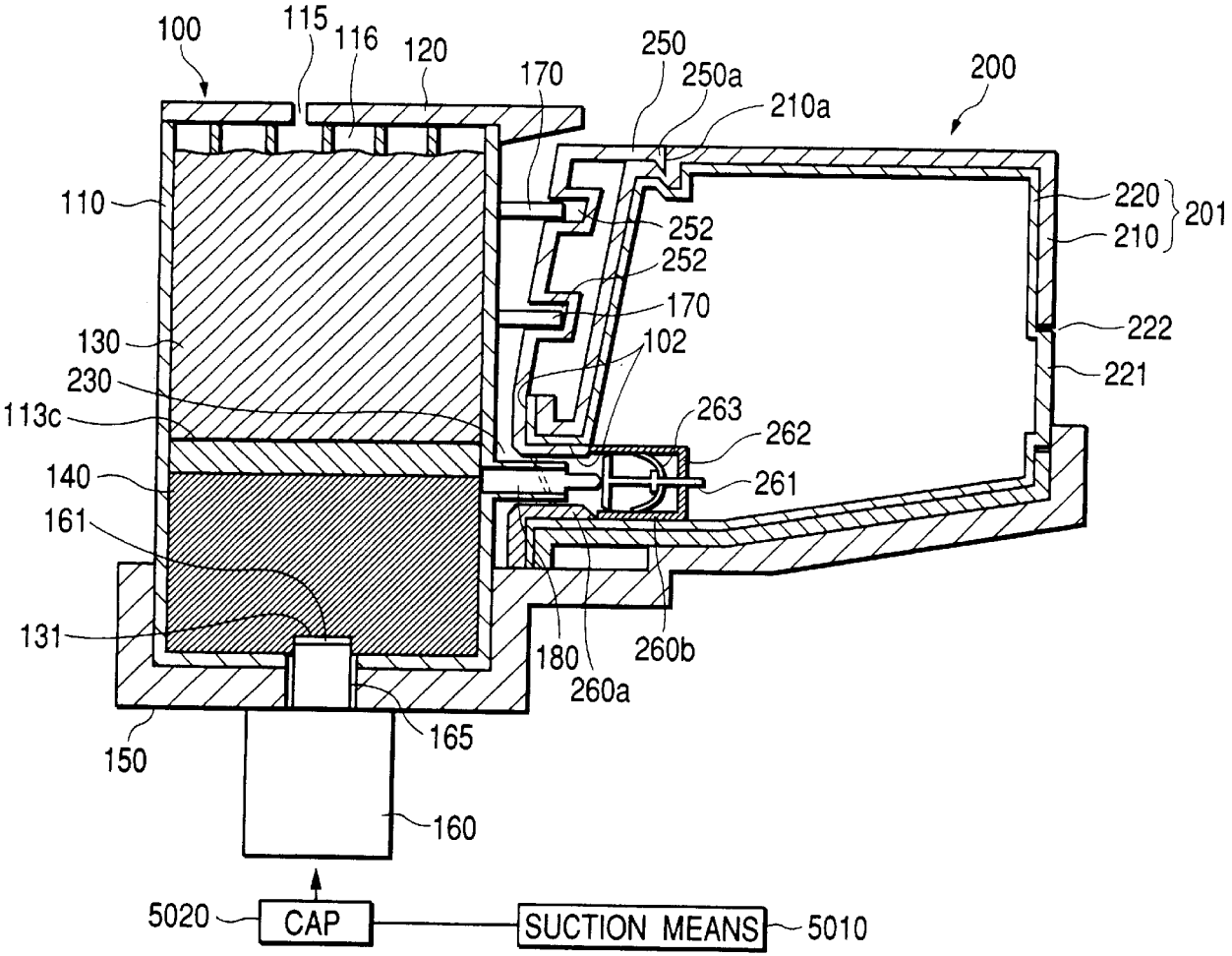
FIG. 12 is a schematic sectional view of an ink jet head cartridge as a constituent of a recording liquid feed device according to the fifth embodiment of the present invention.

As shown in FIG. 12, an absorber contained in a absorber containing chamber of an ink jet head cartridge 70 according to this embodiment is composed of two absorbers 130 and 140. In the state of use of the ink jet head cartridge 70 the absorbers 130 and 140 are loaded into a negative pressure control container 110 in a vertically stacked state at two stages and in a mutually closely contacted state. A capillary force generated by the lower absorber 140 is higher than that generated by the upper absorber 130, that is, the lower absorber 140 possesses a higher ink holding capacity. Ink which is present within a negative pressure control chamber unit 100 is fed to an ink jet head unit 160 through an ink feed tube 165.

The absorber 130 is in communication with an atmosphere communication port 115, while the absorber 140 is in close contact at its upper surface with the absorber 130 and at its lower surface with a filter 161. A boundary surface 113*c* between the absorbers 130 and 140 is positioned higher than an upper end of a joint pipe 180 as a communicating portion at a posture of the pipe in use.

The absorbers 130 and 140 are each constituted by entangled polyolefin fibers (e.g., biaxial fibers with PE formed on PP skin layer). As the absorber 140 are used hydrophilized fibers present in an area (oblique lines' area in FIG. 12) from about a half in height of an opening of the joint pipe 180 up to a feed port 131.

By setting the boundary surface 113*c* between the absorbers 130 and 140 at a position above, preferably above and near (as in this embodiment), the joint pipe 180 at a posture of the pipe in use, the ink-gas interface in the absorbers 130 and 140 can be set to the boundary surface 113*c* in a gas-liquid exchanging operation which will be described later. As a result, it is possible to stabilize a static negative pressure in the head portion during the feed of ink. Moreover, by setting the capillary force of the absorber 140 relatively higher than that of the absorber 130, if ink is present in both absorbers 130 and 140, it becomes possible to have the ink present in the upper absorber 130 consumed first and the ink present in the lower absorber 140 consumed thereafter. In the case where the gas-liquid interface varies due to an environmental change, first the absorber 140 and the vicinity of the boundary surface 113*c* between the absorbers 130 and 140 are charged with ink and thereafter the ink advances into the absorber 130.

In the polyolefin fiber ink absorbers as negative pressure generating members constructed as above, at least the ink feed area from the joint pipe 180 up to the ink feed port 131 is subjected to a hydrophilization treatment. Such a hydrophilized area need not always be from about a half in height of the opening of the joint pipe 180 to the bottom of the negative pressure control container 110 formed with the feed port 131, as indicated with oblique lines in FIG. 12, but it may cover obliquely from about a half in height of the joint pipe opening on one side of the negative pressure control container 110 up to a corner of the bottom of the same container formed with the feed port 131. Or a hydrophilized area may be present at as short a distance as possible so as to describe an arc from about a half in height of the opening to the feed port 131. Or the boundary line 113*c* between the absorbers 130 and 140 may be set to match the height about half of the opening of the joint pipe 180 and the whole of the absorber 140 may be rendered hydrophilic. Such examples of hydrophilized areas are also applicable to the absorber in the liquid container described above in the third and fourth embodiments illustrated in FIGS. 5A, 5B, 6, 7A to 7D, 8A, 8B, 9A to 9D, 10, and 11A to 11F.

According to the above examples, even in the event in gas-liquid exchange operation the liquid level of the upper absorber 130 is disordered and lowers due to a microscopic roughness-fineness difference in the absorber, an outstanding lowering of liquid level in the hydrophilized area (oblique lines' area in the figure) is prevented. To be more specific, air (e.g., arrow A in the figure) in gas-liquid exchange flows from through the upper portion in the joint pipe 180 without breaking off the ink (arrow B in the figure) flowing from the ink container, so that a stable gas-liquid exchanging operation is effected.

Besides, since the vicinity of the ink feed port 131 is rendered hydrophilic, ink tries to be present always around the ink feed port, so that ink shortage is difficult to occur also in the ink feed port 131.

Further, upon replacement with a new ink container 201, the hydrophilized area of the absorber 140 induces ink positively, so that the recovery of the head by both cap 5020 and suction means 5010 can be done rapidly; besides, the amount of ink necessary for the recovery of the head can be controlled in terms of the size of the hydrophilized area.

In the examples shown in FIGS. 5A, 5B, 6, 7A, 7B, 8A, 8B, 9A to 9D, 10, 11A to 11F and 12, the height of the hydrophilized area which is in contact with the opening of the joint pipe 180 is not limited to the illustrated position, but may be set to an optimum height near the pipe opening which height permits the execution of a stable gas-liquid exchanging operation. Particularly, when a positive suction of ink into the absorber is considered, it is desirable for the hydrophilized area be present within the pipe opening to such an extent as does not obstruct the formation of an air path in gas-liquid exchange.

In this embodiment, moreover, since the joint pipe inner surface and the absorber area below the upper end of the joint pipe are rendered hydrophilic, not only the feed of ink becomes smoother, but also the ink present in the connection port is conducted more positively into the joint pipe at the time of replacement of the liquid containing chamber.

(Supplementary explanation on the surface modifying method)

Reference will be made below to a desirable element surface modifying method which is applied to the hydrophilization treatment and water-repelling treatment in the present invention.

According to the following surface modifying method, by utilizing functional groups of molecules contained in the material which constitutes an element surface, a polymer (or fragmented products thereof) is allowed to be specifically oriented and adhered onto the element surface and a property of the groups contained in the polymer (or fragmented products thereof) is imparted to the element surface, thereby permitting a desired surface modification.

The word "element" as referred to herein means a thing formed using any of various materials and retaining a certain external form. In association with the external form it has an outer surface exposed to the exterior. In its interior there may be present a void or cavity portion including a portion communicating with the exterior, or a hollow portion. An inner surface (inner wall surface) as a partition of those portions may also be a partial surface to be subjected to the surface modifying treatment according to the present invention. As the hollow portion is included one having an inner defining surface and being a space completely isolated from the exterior. Before the modification treatment, the surface treating solution may be applied into the hollow portion. Thus, insofar as the hollow portion becomes isolated from the exterior after the modification treatment, it may be subjected to the treatment according to the present invention.

Thus, the surface modifying method according to the present invention is applied to a surface with which the liquid surface treating solution from outside can be brought into contact without impairing the element shape out of all the surfaces of the element concerned. Either an outer surface of the element or an inner surface connected thereto, or both, are regarded as the partial surfaces as referred to herein. Modifying the properties of partial surfaces selected and subdivided from the element surface concerned is also included in the present invention. The mode of selecting an outer surface of an element and an inner surface connected thereto is also included in the modification of a desired partial surface area.

In the surface modification described above, a portion (a partial surface) to be modified which constitutes at least a part of surfaces of an element is treated; that is, a part or the whole of an element surface selected as desired is subjected to the modification treatment.

By the expression "fragmentation of a polymer" as referred to herein is meant a partial scissioning of a polymer or is meant a monomer as it is. When viewed from the standpoint of embodiments, it covers all of embodiments in which a polymer is cleaved with a cleavage catalyst such as an acid. The "formation of a polymer film" as referred to herein includes a substantial film formation or different orientations of various portions with respect to a two-dimensional surface.

The "polymer" as referred to herein indicates a polymer having a first moiety containing a functional group and a second moiety having an interfacial energy different from an interfacial energy of the functional group and almost equal to a surface energy of the element to which the polymer is to be adhered. It is preferred that the polymer be different from the constituent material of the element surface referred to above. Therefore, according to the constituent material of an element to be surface-modified, a suitable polymer may be selected from among polymers each having an interfacial energy almost equal to a surface energy of the element surface. More preferably, the polymer should be capable of being cleaved and capable of being condensed after the cleavage. The polymer may have functional groups other than in the first and second moieties, but in this case, with the hydrophilization treatment as an example, it is preferable that the hydrophilic groups as functional groups be relatively long-chained with respect to the other functional groups which are relatively hydrophobic with respect to the hydrophilic groups.

[Principle of the surface modification]

The surface modification for an element according to the present invention is effected by utilizing a polymer in which a main skeleton (a generic term for backbone and pendant groups, as well as a cluster of groups) having an interfacial energy almost equal to a surface (interfacial) energy of the element surface (base surface) and a group having an interfacial energy different from the element surface (interfacial) energy are bonded together, then by allowing the polymer to adhere to the element surface with use of the main skeleton portion, and by allowing a polymer film (coating) to be formed in which the group having an interfacial energy different from the interfacial energy of the element surface is oriented outside with respect to the element surface.

When viewed from a different standpoint, it can be said that the polymer used as the surface modifier is a polymer having a first group essentially different in affinity from a group exposed to the element surface before modification and a second group which exhibits affinity substantially similar to the group exposed to the element surface and which is contained in a repeating unit included in the main skeleton.

Figure 13A:
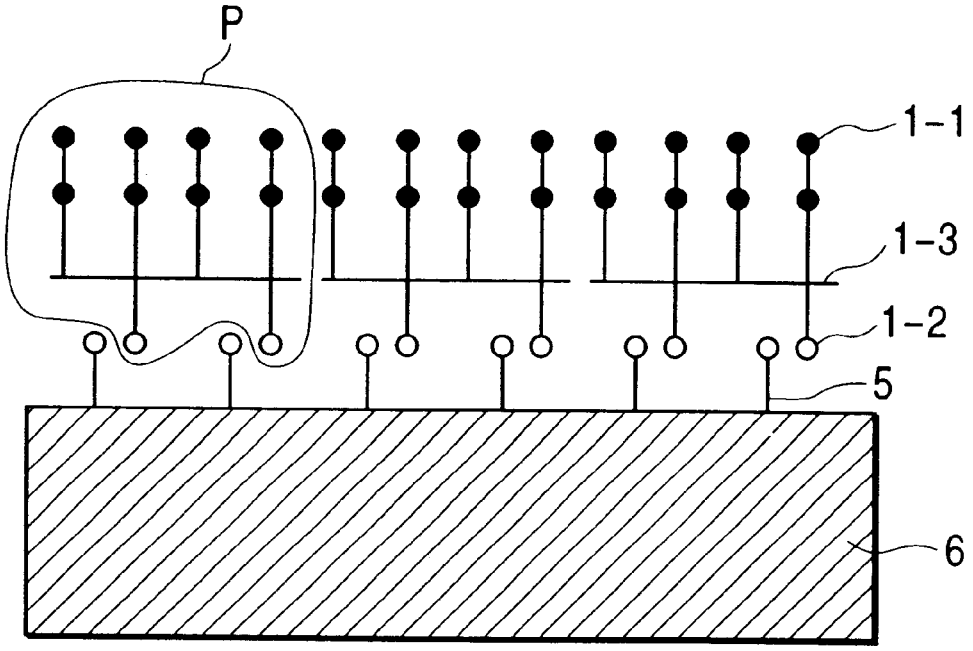
Figure 13B:
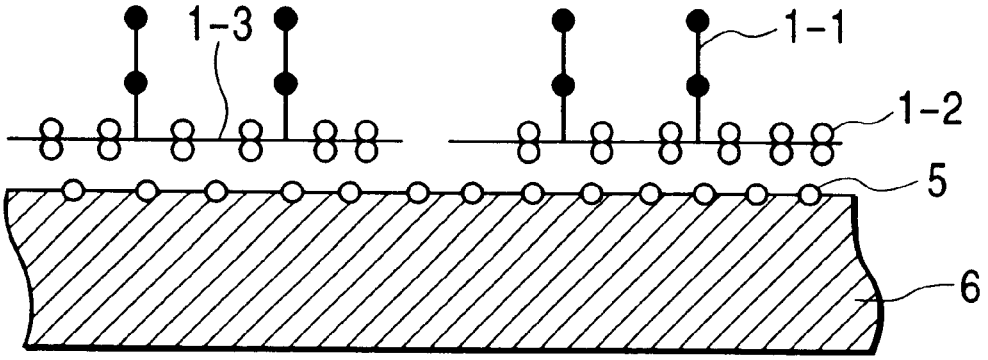

It is FIGS. 13A and 13B that schematically shows a typical example of such an orientation form. In the example shown in FIG. 13A there is used a polymer in which first groups 1-1 and second groups 1-2 are bonded as pendant groups to a main chain 1-3. In the example shown in FIG. 13B, second groups 1-2 constitute a main chain 1-3 and second groups 1-2 constitute side chains.

Figure 33:
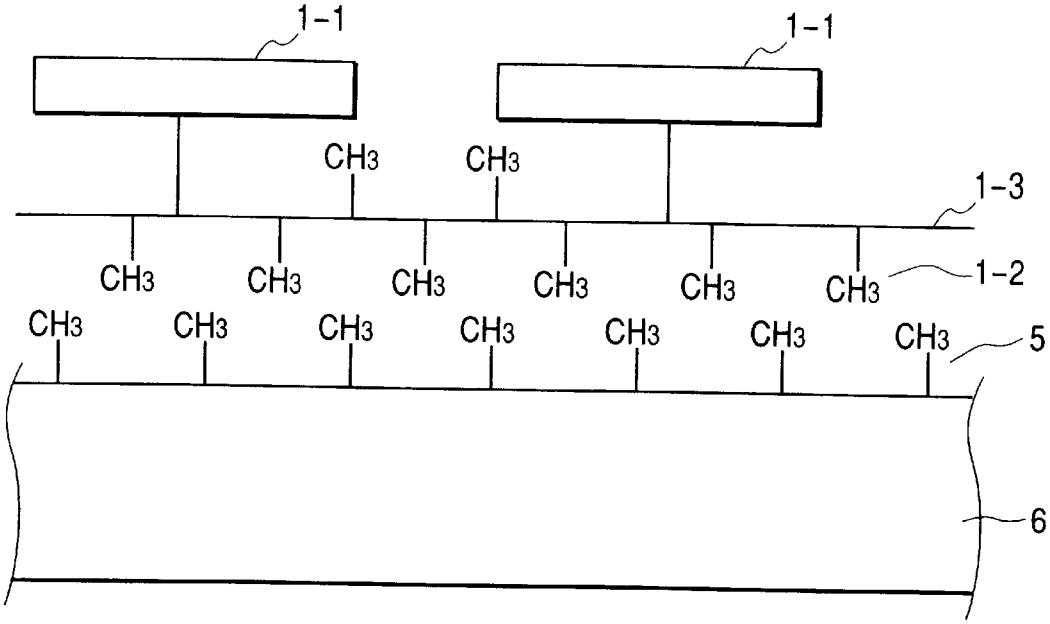
FIG. 33 is a diagram showing an example of an estimated surface distribution of hydrophilic and hydrophobic groups by a surface modifying treatment applicable to the invention.
Figure 34A:
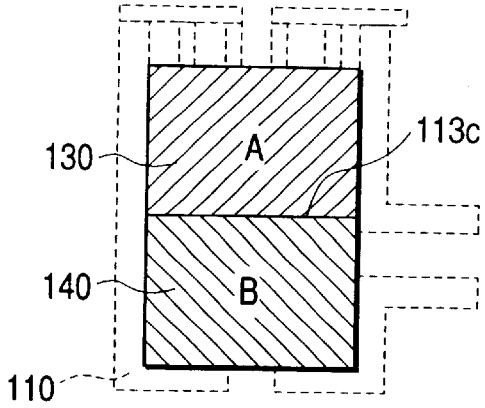
FIGS. 34A, 34B and 34C are diagrams showing examples of a hydrophilization treatment for a negative pressure generating member (absorber) in an ink jet head cartridge applicable to the invention.
Figure 34B:
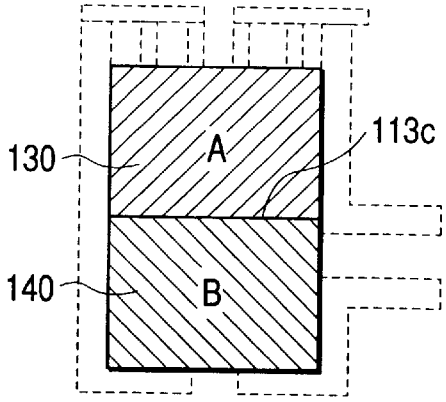
Figure 34C:
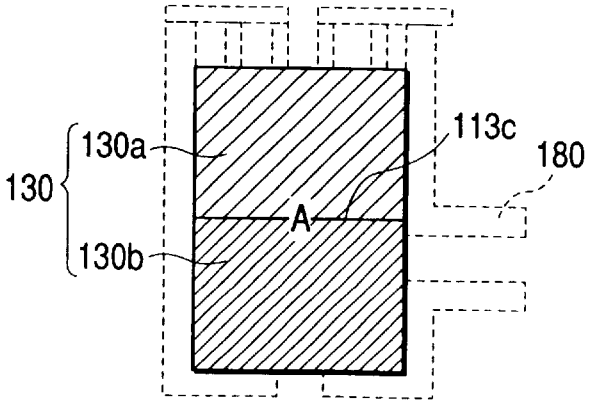
Figure 35A:
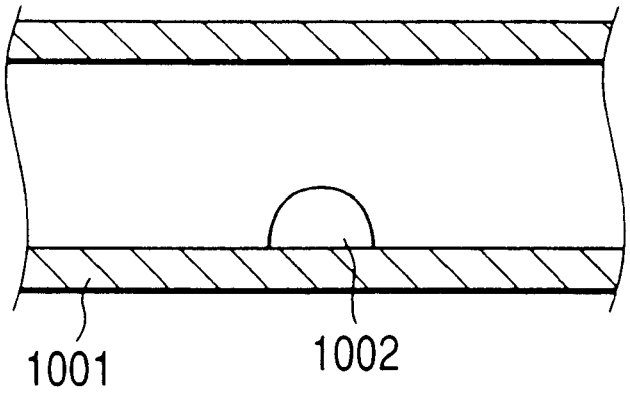
FIG. 35A PRIOR ART
FIGS. 35A and 35B are sectional views of a feed pipe 1001 used in a conventional ink jet printer.
Figure 35B:
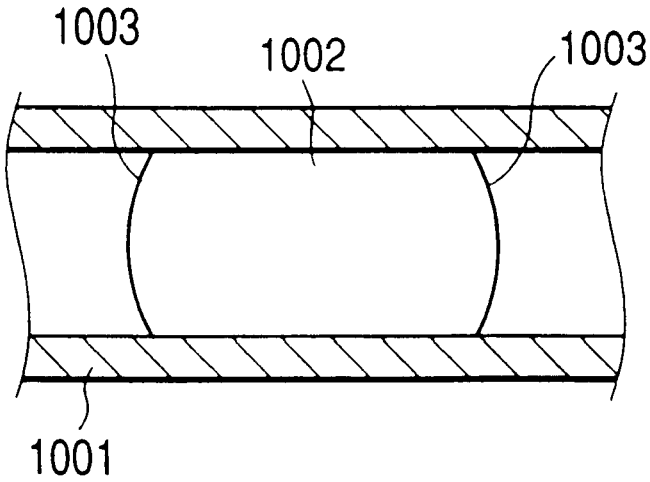
FIG. 35B PRIOR ART

According to the orientation shown in FIGS. 13A and 13B, on the outermost surface of a base 6 which constitutes an element surface to be modified there are oriented groups 1-1 having an interfacial energy different from a surface (interfacial) energy of the base 6, so that a property associated with the groups 1-1 is utilized to modify the element surface. The surface (interfacial) energy of the base 6 is determined on the basis of groups 5. In connection with the surface (interfacial) energy of the base 6, surface-constituent material and molecules depend on groups 5 exposed onto the surface. More specifically, in the example shown in FIGS. 13A and 13B, the first groups 1-1 act as functional groups for surface modification, and if the surface of the base 6 is hydrophobic and the first groups 1-1 are hydrophilic, a hydrophilic nature is imparted to the surface of the base 6. If the first groups 1-1 are hydrophilic and the groups 5 on the base 6 are hydrophobic, then for example in the case of utilizing a polysiloxane which will be described later, it is presumed that such a state as shown in FIG. 33 exists on the surface of the base 6. In this state, by adjusting the balance between hydrophilic groups and hydrophobic groups on the surface of the base 6 after modification, it is also made possible to control the state of passage or the flow rate during passage if water or an aqueous liquid consisting principally of water passes through the surface of the base after modification. Further, by disposing, say, a polyolefin fibrous member having such a modified surface as an outer wall surface into an ink tank integral with or separate from the ink jet recording head, it becomes possible to charge ink into or feed ink from the ink tank in an extremely effective manner; besides, by ensuring a moderate negative pressure within the ink tank it becomes possible to ensure an appropriate ink interface (meniscus) position in the vicinity of the ink ejection orifice in the recording head just after ink ejection. Consequently, it becomes possible to afford a state that a positive negative pressure is higher than a dynamic negative pressure, the said state being best suited to the negative pressure generating member which holds ink to be fed to the ink jet recording head.

Particularly, in the fiber surface structure shown in FIG. 33, the hydrophilic groups 1-1, because of high-molecular groups, are longer than pendant methyl groups (hydrophobic groups) on the same side. Therefore, when ink flows, the hydrophilic groups 1-1 tilt along the fiber surface relative to the ink flow velocity. (At the same time the hydrophilic groups come to substantially cover the methyl groups). As a result, the flow resistance becomes considerably low. Conversely, when the ink flow stops and a meniscus is formed between fibers, the hydrophilic groups 1-1 are oriented in a direction against the ink, i.e., perpendicularly to the fiber surface, so that (because of exposure of the methyl groups onto the fiber surface) there is formed a hydrophilic (large)-hydrophobic (small) balance on an intramolecular level and a sufficient negative pressure can be formed. Since many (at least plural) hydrophilic groups 1-1 are contained in the polymer as in the previous embodiment in which the hydrophilic groups 1-1 are constituted by both many (—C—O—C—) bonds and OH groups as end groups, the action of the hydrophilic groups 1-1 can be ensured. In the case where a hydrophobic group other than methyl group is contained in the polymer, it is preferred that the hydrophilic groups be at a higher molecular level so that the existence range of the hydrophilic groups is larger than that of the hydrophobic groups. The foregoing hydrophilicity>hydrophobicity balance should be ensured.

A static negative pressure in the ink feed port is represented by the following equation:

Static negative pressure=(height of an ink interface from the ink feed port)−(capillary force of fibers at the ink interface)

The capillary force is proportional to cos θ if a wet contact angle between ink and the fibrous member is assumed to be θ. Thus, according to whether the hydrophilization treatment of the invention is performed or not, it becomes possible to make adjustment so that a static negative pressure of ink is set rather low, or rather high in terms of an absolute value, if a change in Cos θ of the ink is large.

To be more specific, in the case of a 10° level contact angle, an increase of the capillary force will be 2% or so at most even if the hydrophilization treatment is performed, but if the contact angle is decreased to below 10° by the hydrophilization treatment from a difficult-to-wet combination of ink and fiber, say, the state of 50° in contact angle, a 50% increase of the capillary force is attained. (cos 0°/cos 10°≅1.02, cos 10°/cos 50°≅1.5)

Now, in connection with a concrete method for manufacturing an element having such a modified surface as shown in FIGS. 13A and 13B, a description will now be given of a method using an improver which is a good solvent for the polymer used in the surface modification and which improves the wettability of the treating agent for the base as an element to be surface-modified. According to this method, a treating solution (a surface modifying solution), in which the polymer as the surface modifier is dissolved homogeneously, is applied onto a surface of the base and then the polymer as the surface modifier contained in the treating solution is oriented as described above while the solvent contained in the solution is removed.

More specifically, the method comprises the steps of preparing a solution (a surface treating solution preferably containing pure water in the case of functional groups being hydrophilic groups) with predetermined amounts of a polymer and a cleavage catalyst mixed into a solvent which is a good solvent for the polymer and which possesses sufficient wettability for the surface of the base to be treated, applying the surface treating solution onto the base surface, and subsequent drying (say, in a 60° C. oven) to evaporate off the solvent from the treating solution.

The use of an organic solvent which exhibits sufficient wettability for the surface of the base and which dissolves the polymer as the surface modifier is desirable from the standpoint of facilitating a uniform application of the polymer. Such an organic solvent is also effective in keeping the polymer dispersed uniformly and dissolved satisfactorily in the applied liquid layer when the polymer becomes higher in its concentration with evaporation of the solvent. Besides, since the surface treating solution is sufficiently wettable for the base surface, the polymer as the surface modifier can be spread uniformly onto the base surface, with the result that a uniform polymer coating can be formed even on a surface having a complicated shape.

In the surface treating solution there may be contained, in addition to the first solvent which is volatile and wettable for the base surface and which is a good solvent for the polymer, a second solvent which is a good solvent for the polymer and which, however, is relatively inferior in wettability for the base surface and is relatively less volatile in comparison with the first solvent. As such an example, mention may be made of a combined use of isopropyl alcohol and water as will be described later in the case of using a polyolefin resin as the material of the base surface and a polyoxyalkylene-polydimethylsiloxane as the polymer.

It is presumed that the addition of an acid as a cleavage catalyst into the surface treating solution will bring about the following effects. For example, upon increase in concentration of an acid component with material evaporation in the course of evaporation and drying of the surface treating solution, the acid of a high concentration involving heat causes a partial decomposition (cleavage) for the polymer used for surface modification to afford fragmented products of the polymer, thus making polymer orientation to finer portions of the base surface possible. Moreover, in the final stage of drying and evaporation the formation of a polymer film (polymer coating or monomolecular film) is accelerated through re-combination of cleaved moieties of the polymer into the surface-modifying polymer.

Further, when the concentration of the acid component increases with solvent evaporation in the course of drying and evaporation of the surface treating solution, this highly concentrated acid eliminates impurities present on and near the base surface, whereby a base surface cleaning effect can be expected. On such a clean surface it is also expected that a physical adhesion between the base material molecules and the polymer as the surface modifier will be improved.

In this connection, the base surface is decomposed by the highly concentrated acid involving heat and there appear active points on the same surface, so that there may occur a secondary chemical reaction in which the active points and the above fragmented products of the polymer are joined together. As the case may be, the adhesion stability of the surface modifier on the surface may be improved by such a secondary chemical adsorption of the surface modifier and the base.

Next, with reference to FIGS. 14, 15, 16A, 16B, 17 to 20 and with the case where the functional group is a hydrophilic group and a hydrophilic nature is imparted to a hydrophobic base surface as an example, a description will be directed to a polymer film forming process by both cleavage of a main skeleton of the surface modifier (containing a hydrophilic treating solution) having a surface energy almost equal to a surface energy of the base and condensation of fragmented products on the base surface. The hydrophilic group indicates a group having a structure capable of imparting a hydrophilic nature as the entire group. Not only a hydrophilic group itself but also even a group having a hydrophobic chain or group is included if substituted with a hydrophilic group to afford a group capable imparting a hydrophilic nature.

Figure 14:
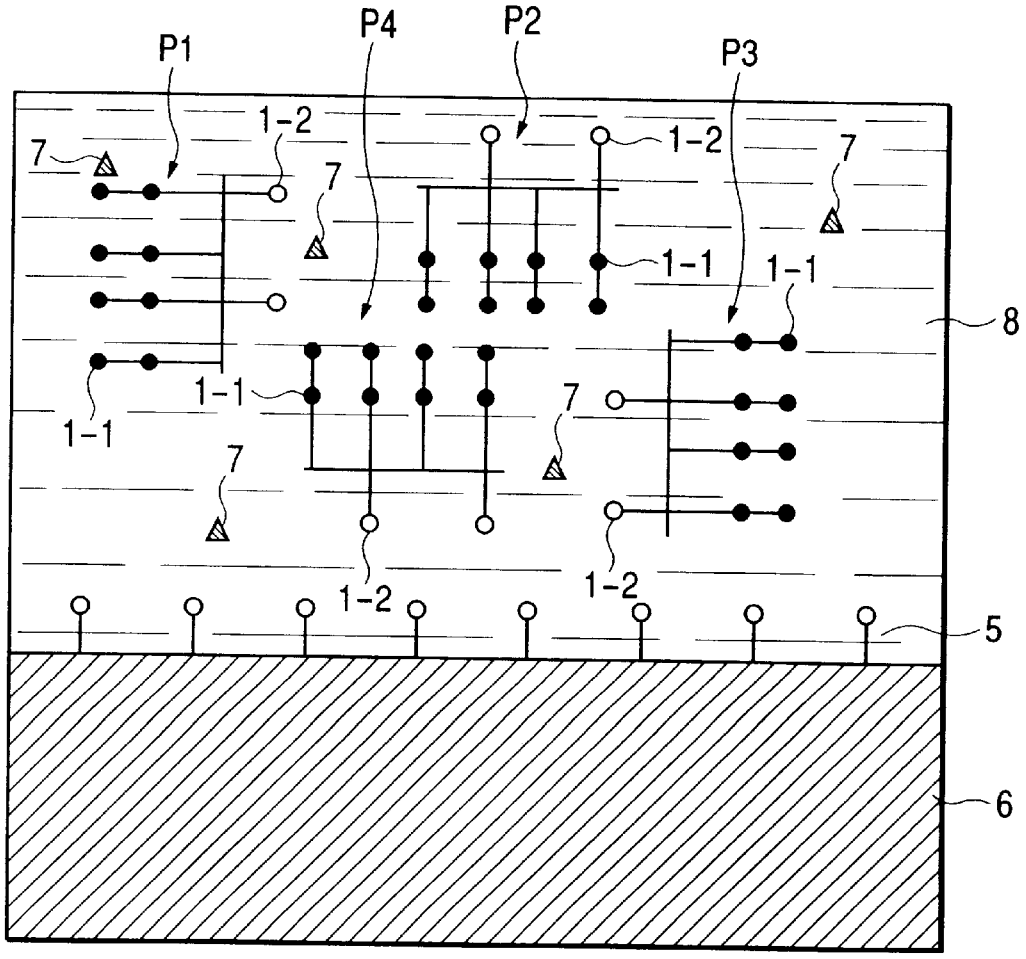
FIG. 14 is a diagram showing schematically a base coated with a layer of a treating solution containing a polymer as a surface modifier in a surface modifying method applicable to the invention.
Figure 15:
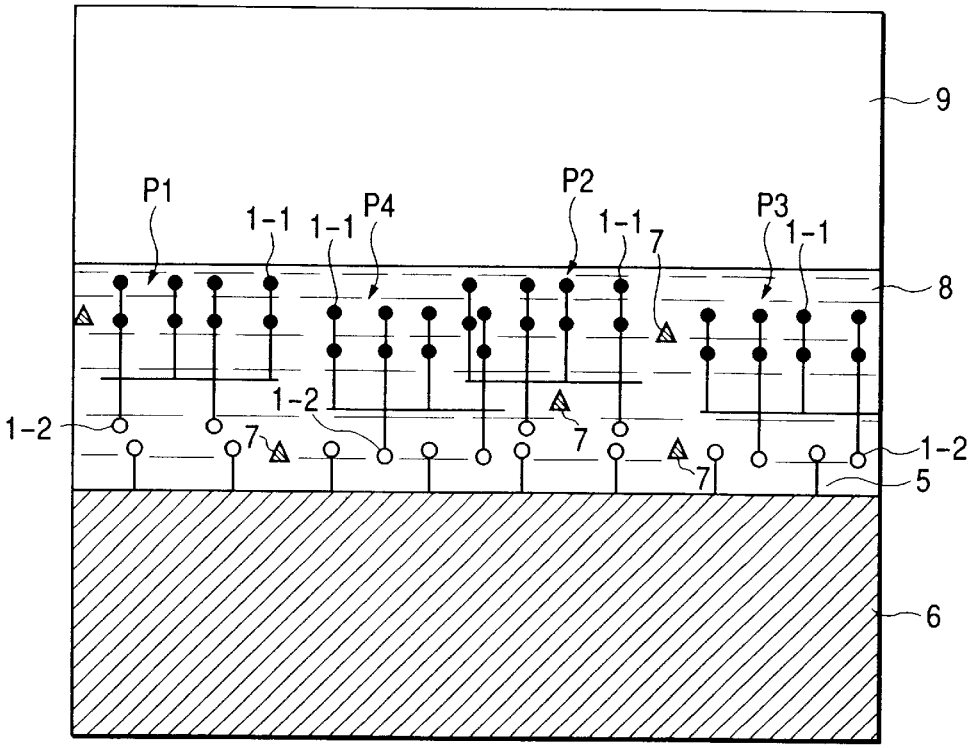
FIG. 15 is a conceptual diagram showing a step of partially removing a solvent from the coating layer containing the polymer as a surface modifier and formed on the base in the surface modifying method applicable to the invention.

FIG. 14 is an enlarged diagram after the application of a hydrophilizing solution 8. At this time, hydrophilizing polymer moieties P1 to P4 and acid moieties 7 contained in the solution 8 are dissolved homogeneously in the solution on the surface of the base 6. FIG. 15 is an enlarged diagram of a drying process after the application of the treating solution. In this drying process involving heating, the concentration of the acid component increases with evaporation of the solvent, with consequent elimination of impurities present on and near the surface of the base 6, and a pure base surface is formed by the base surface cleaning action, whereby a physical adsorptivity of the base 6 and that of the surface modifying polymers P1 to P4 are improved. In this drying process, moreover, the hydrophilizing polymer moieties P1 to P4 are partially cleaved by an increase in concentration of the acid component which is attributable to solvent evaporation.

Figure 16A:
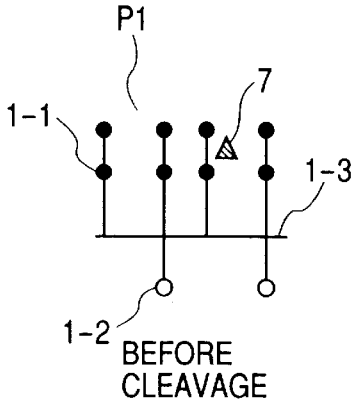
FIGS. 16A and 16B are conceptual diagrams showing a partial dissociation process of the polymer as a surface modifier which is associated with the partial solvent removing step from the polymer coating layer and which is induced by an acid added into the treating solution.
Figure 16B:
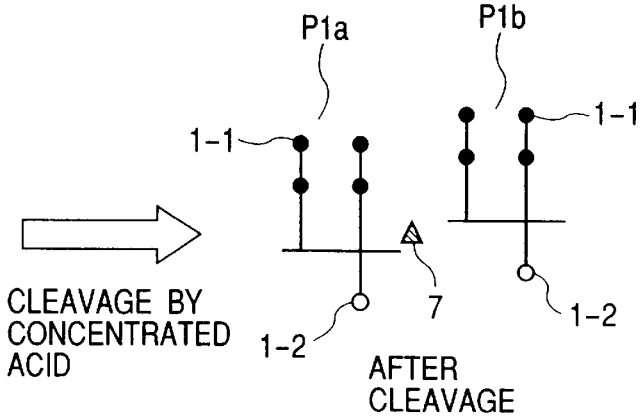
Figure 17:
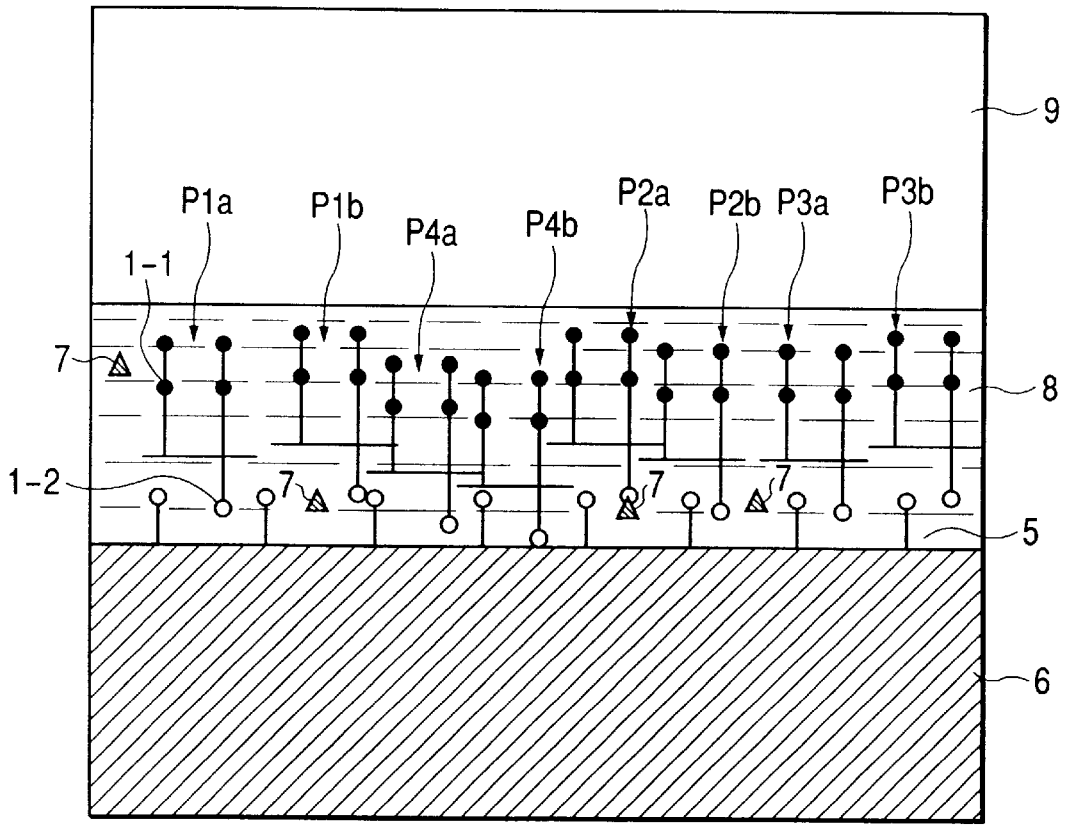
FIG. 17 is a conceptual diagram showing an orienting process of the polymer as a surface modifier or fragmented products thereof in association with a further solvent removing step from the coating layer containing the polymer.

FIGS. 16A and 16B schematically show in what manner the polymer moiety P1 is decomposed by the concentrated acid and FIG. 17 shows in what manner the thus-decomposed hydrophilizing agent is adsorbed on the base. As the solvent evaporation proceeds, main skeleton portions of fragmented products P1*a* to P4*b* from the polymer as a constituent of the hydrophilizing agent which has reached a dissolving saturation, having a surface energy substantially equal to that of the base, adhere selectively onto the surface of the base 6 which is now a pure surface obtained by washing. As a result, groups 1-1 contained in the surface modifier and having a surface energy different from that of the base 6 are oriented outside with respect to the base 6.

Figure 18:
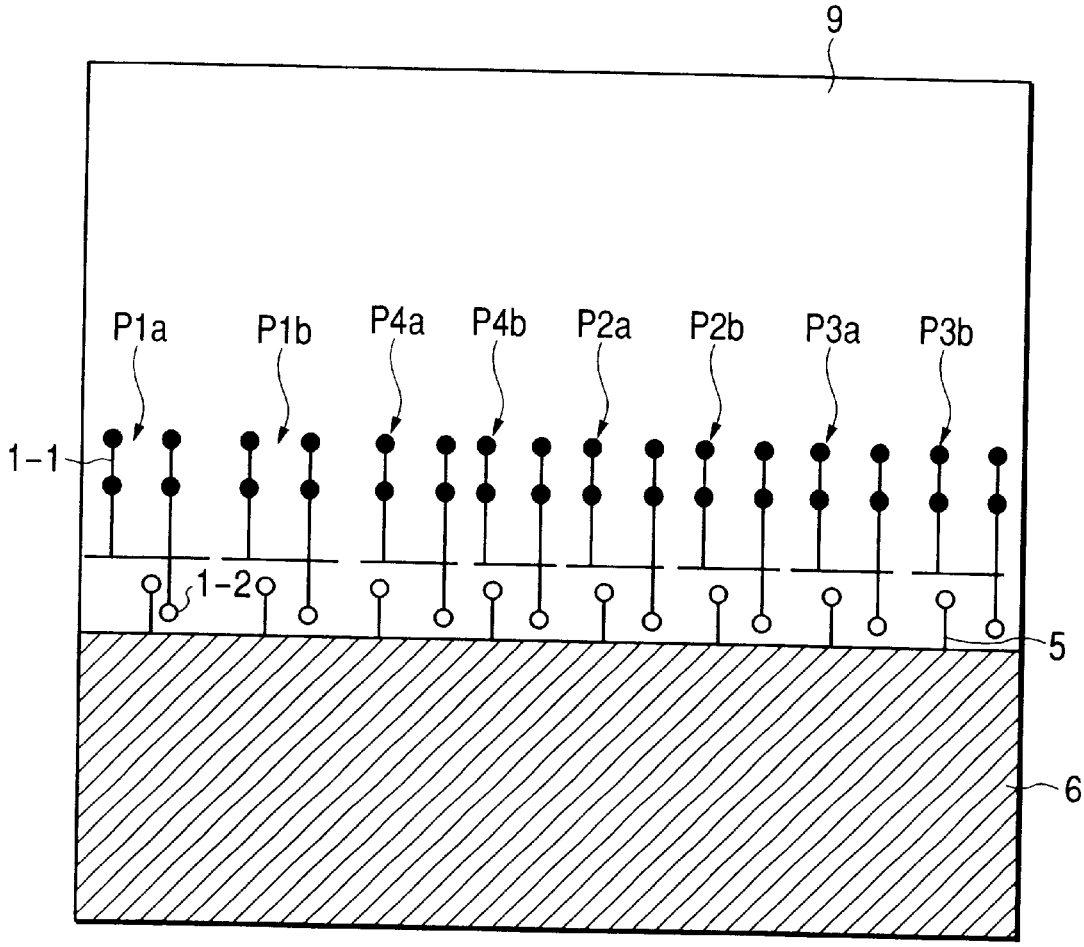
FIG. 18 is a conceptual diagram showing in what process the solvent contained in the coating layer is dried off and the polymer as a surface modifier or fragmented products thereof are oriented, adhered and fixed onto the element surface.

Thus, the main skeleton portions having an interfacial energy almost equal to that of the surface of the base 6 are oriented on the base surface and the groups 1-1 having a surface energy different from that of the base 6 are oriented outside opposite to the base surface, so that a hydrophilic nature is imparted to the surface of the base 6 if the groups 1-1 are hydrophilic groups, and thus the base surface is modified. FIG. 18 schematically illustrates an adsorbed state of the hydrophilizing agent and the base surface after the application of the hydrophilizing solution and subsequent drying.

Figure 19:
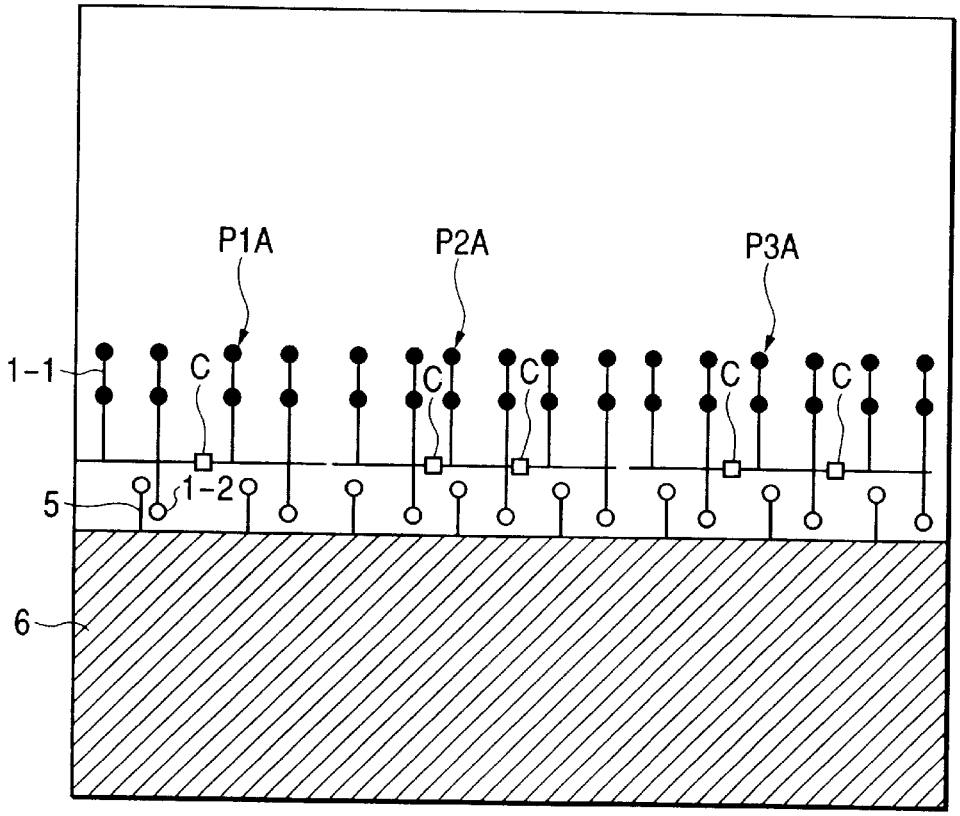
FIG. 19 is a conceptual diagram showing in what process fragmented products derived from the polymer as a surface modifier which is adhered and fixed onto the element surface are re-combined by a condensation reaction.

By using as the polymer, for example, a polymer such as polysiloxane in which fragmented products from the polymer can be bonded at least partially by condensation, it is possible to allow a linkage to be formed between fragmented products adsorbed on the surface of the base 6, to afford a polymeric state, and hence possible to make the film of the hydrophilizing agent stronger. FIG. 19 schematically illustrates a recombined state by such a condensation reaction. The formation of fragmented products using polysiloxane and the condensation thereof into the polymer are effected in the following mechanism.

With controlled drying of the surface treating solution on the surface to be treated, the concentration of the dilute acid contained in the surface treating agent increases and the thus-concentrated acid (e.g., $H_2SO_4$) causes the siloxane bond in the polysiloxane to be cleaved, resulting in formation of fragmented products of the polysiloxane and silylsulfuric acid (Scheme 1). As the treating solution present on the surface to be treated is further dried, the concentration of the fragmented products contained in the treating solution also increases, with consequent improvement in the contact probability between fragmented products. As a result, as shown in Scheme 2 below, fragmented products are condensed with each other to reproduce the siloxane bond. Also as to the silylsulfuric acid as a by-product, if the surface to be treated is hydrophobic, methyl groups of the silylsulfuric acid are oriented toward the to-be-treated surface, while sulfone groups are oriented in a direction different from the to-be-treated surface. Thus, it is presumed that the silylsulfuric acid will make some contribution to the hydrophilization of the surface to be treated.

[General formula 2]

Scheme 1

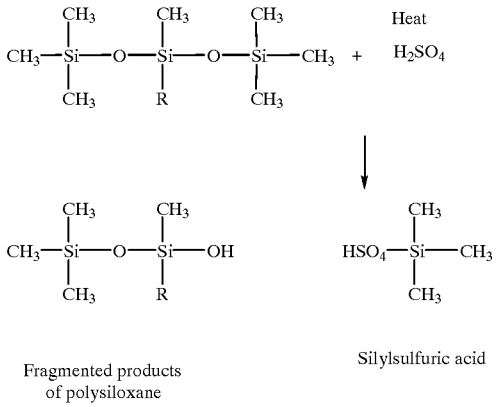

Scheme 2

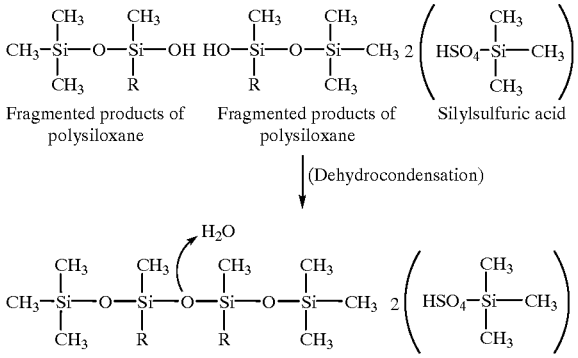

Figure 20:
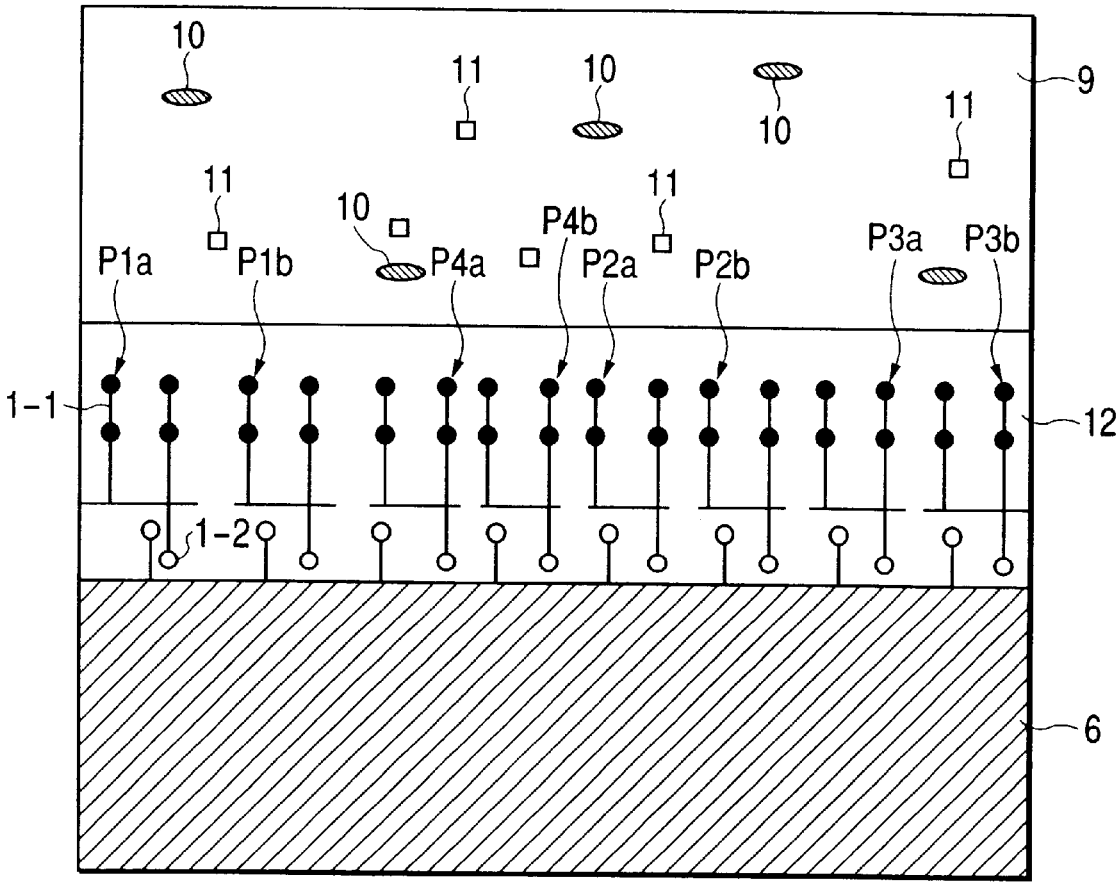
FIG. 20 is a conceptual diagram showing an example of applying a surface modifying method applicable to the invention to a hydrophilizing treatment for a water-repellent surface and also showing what effect is obtained by adding water into a treating solution.

FIG. 20 schematically shows an example of a state of a surface treating solution having a composition with water present in a solvent. If water is present in the solvent of the treating solution, both water and a volatile organic solvent evaporates in the course of solvent evaporation from the hydrophilizing solution under heating (gas molecules of water and of the organic solvent are indicated at 11 and 10, respectively). In this case, since the evaporating speed of the volatile organic solvent is higher than that of water, the concentration of water in the treating solution increases, with consequent increase in surface tension of the treating solution. As a result, there occurs a difference in surface energy at the interface between the to-be-treated surface of the base 6 and the treating solution, and portions of the fragmented products P1*a*~P4*b* from the hydrophilizing polymer, which portions have a surface energy almost equal to that of the to-be-treated surface of the base 6, are oriented on the base surface side at the interface between the base surface and the treating solution (a hydrous layer 12) with an enhanced water concentration by evaporation. On the other hand, the hydrophilic group-containing portions of the fragmented products from the polymer are oriented on the hydrous layer 12 side where the water concentration has been enhanced by evaporation of the organic solvent. As a result, it is presumed that a predetermined orientability of the polymer fragmented products will be further improved.

The present invention is concerned with such structures as tube, pipe and filter in a liquid feed path used for a liquid ejection head and is also concerned with a fibrous absorber for ink jet which holds ink by a negative pressure. Particularly, according to the present invention, a hydrophilization treatment is applied to their inner surfaces. In the element surface modifying method according to the present invention described above, the element to be surface-modified is not limited to fibers, but various other elements and uses are mentioned according to characteristics and types of polymer functional groups. Reference will be made below to several examples.

(1) In case of the functional group being a hydrophilic group:

An element to be treated is one which requires absorbability such as an ink absorber used in an ink jet system (the foregoing embodiments are applicable to the case where olefin fibers are included). By the surface modifying method according to the present invention it is possible to impart such a hydrophilic nature as permits instantaneous absorption of ink (e.g., such a water-based ink as referred to in the above embodiments) to the element to be surface-modified. The surface modifying method in question is also effective in the case where a liquid retaining property is required.

(2) In case of the functional group being a lipophilic group:

By the surface modifying method according to the present invention, even for an element requiring a lipophilic nature it is possible to meet the requirement effectively.

(3) All of other applications of the surface modification are covered if they can be attained using the mechanism of the above principle.

Particularly, if there is used a treating agent containing a wettability improver (e.g., isopropyl alcohol (IPA)) capable of improving wettability for an element surface and capable of improving wettability which permits dissolving of a polymer, a medium for inducing polymer cleavage, and a polymer containing any of the foregoing functional groups and a group (or a cluster of groups) having an interfacial energy different from that of the functional group and almost equal to a partial surface energy of the element surface, there can be attained a particularly excellent surface modification effect by condensation after the cleavage. It is possible to ensure such uniformity and characteristics as have heretofore been unattainable.

The property superior in wettability for the contained liquid is herein designated "lyophilic nature."

Reference will now be made to a supplemental concept of the present invention. A neutralizer (e.g., calcium stearate or hydrotalcite) used in molding or forming fibers and other additives are sometimes contained in the fibers, but according to the surface modifying method described above it is possible to diminish dissolving or precipitation of such neutralizer and other additives in ink and this problem can be solved if the polymer film defined in the invention is formed. Thus, according to the surface modifying method described above, not only the application range of neutralizer and other additives can be expanded and it is possible to prevent a change in characteristics of ink itself, but also a change in characteristics of the ink jet head itself can be prevented.

Figure 32:
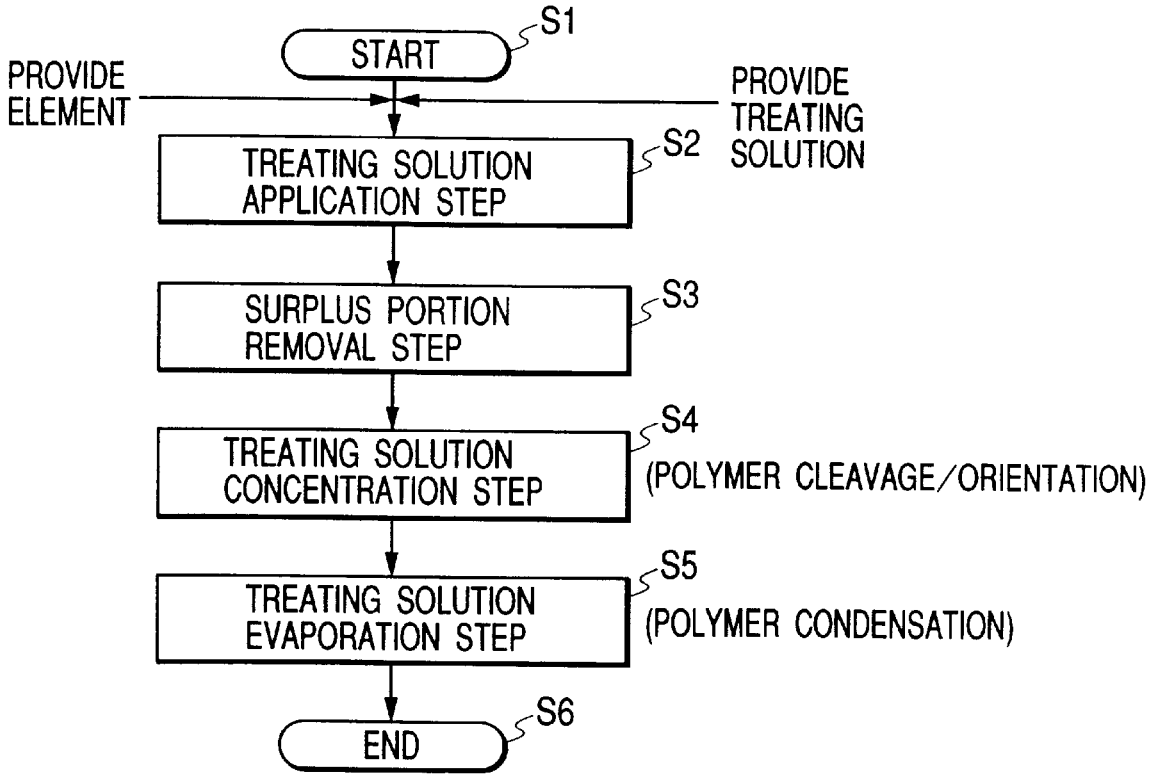
FIG. 32 is a process chart showing an example of a surface modifying process applicable to the invention.

An example of a process chart in the manufacture of these various products is shown in FIG. 32. At the beginning of manufacture (S1) both element and treating solution are provided, then there are carried out a treating solution application step of applying a treating solution to a surface (a to-be-modified surface) of the element (S2), a surplus portion removal step of removing a surplus portion from the surface to be modified (S3), a treating solution concentrating and evaporation step for the cleavage of a polymer and orientation of fragmented products on the surface to be modified (S4), and a polymer condensation step for bonding between fragmented products into the polymer (S5). Through these steps there can be obtained an element having a modified surface (S6).

The treating solution concentrating step and the treating solution evaporation step (S4, S5) can be carried out by a continuous heat-drying step preferably at a temperature (say, 60° C.) higher than room temperature and below the boiling point. For example, the drying treatment time may be about 45 minutes to 2 hours in case of using a polysiloxane having a hydrophilic group for modifying a polyolefin resin surface together with water, an acid, and an organic solvent (say, isopropyl alcohol), and may be 2 hours or so in the use of a 40 wt % aqueous isopropyl alcohol solution. The drying treatment time can be shortened by decreasing the water content.

Although in the example shown in FIG. 32 fragmented products of the polymer are formed on the to-be-modified surface of the element, a treating solution already containing such fragmented products may be fed onto the to-be-modified surface of the element and orientation may be allowed to take place.

For example, as noted earlier, the treating solution employable in the invention contains a wettability improver for improving the wettability of the treating solution for the surface to be modified, the wettability improver possessing wettability for the surface to be modified and being a good solvent for a polymer which is an effective surface modifying component, a solvent, a polymer cleaving catalyst, and the polymer containing a functional group for imparting a modifying effect to the surface to be modified and also containing a group for adhesion to the surface to be modified.

[Principle Application Example 1]

Figure 21A:
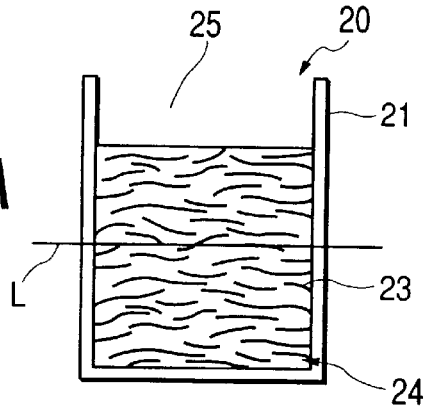

Description is now directed to an example in which the above principle of surface hydrophilization is applied to a polypropylene-polyethylene fibrous member. For example, an actual polypropylene-polyethylene fibrous member is in a lumpy shape of combined fibers which shape permits the fibrous member to be used as an ink absorber for holding ink. For example, as shown in FIG. 21A, a fibrous member 23 which functions as an absorbing and holding member for various liquids, including ink, is received at a predetermined orientation into a container 21 of a suitable shape having an opening 25 which is open to the atmosphere, and thus the fibrous member can be used as a liquid holding container. Further, such an ink absorber is suitably employable within an ink tank used in an ink jet recording apparatus. Particularly, as will be described later with reference to FIGS. 23A to 23F and 24A to 24F, if after the fibrous absorber impregnated with a hydrophilic treating solution has been depressed to squeeze out a surplus treating solution from fiber gaps, followed by heat-drying, the fibrous absorber is received within a tank, it is desirable that the treating solution squeezing-out direction and the fibrous absorber compressing direction when inserted into the tank be aligned with each other. That is, for example even if fiber branching or hydrophilizing agent adhesion is not ensured when the fibrous absorber has been restored to its original state from the compressed state in the treating solution squeezing work, such an inconvenience can be offset at the time of insertion of the fibrous absorber into the tank.

The fibrous absorber is constituted by a biaxial fibrous member of polypropylene and polyethylene, in which individual fibers are approximately 60 mm long. This biaxial fibrous member, as illustrated its sectional shape in FIG. 22A, has a generally circular (closed ring-like) external form (outer periphery shape) in a section thereof perpendicular to the axis, in which polypropylene fibers relatively high in melting point are used as a core 23*b* and polyethylene fibers relatively low in melting point are disposed as a sheath 23*a* around the core. Short fibers of such a sectional structure are aligned their arranged direction by means of a carding machine and then heated to induce fusion-bonding between adjacent fibers. To be more specific, heating is conducted to a temperature higher than the melting point of polyethylene as the sheath 23*a* and lower than the melting point of polypropylene as the core 23*b* to afford a structure in which polyethylene fibers are fusion-bonded together at each contacted portion of fibers.

Figure 21B:
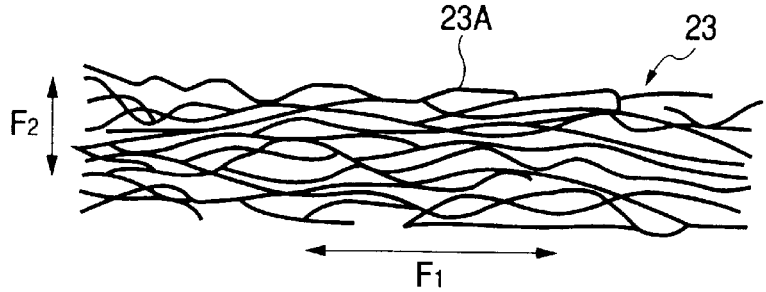
Figure 21C:
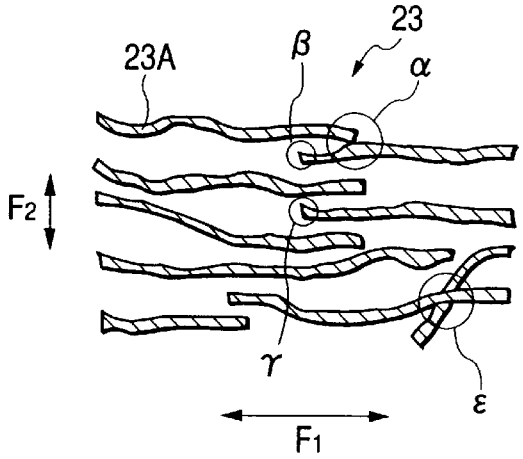
Figure 21D:
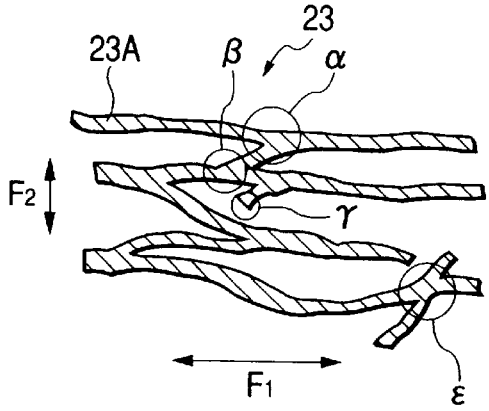

In the above fibrous structure, as shown in FIG. 21C, since the fibers are aligned by the carding machine, the fibers are continuously arranged mainly in a longitudinal direction (F1) and are partially contacted with each other. Heating induces fusion-bonding of adjacent fibers at each of such contact points (intersecting points) to form a net structure. This net structure affords a mechanical elasticity in a direction (F2) orthogonal to the longitudinal direction (F1). Accordingly, a tensile strength in the longitudinal direction (F1) shown in FIG. 21B increases, whereas a tensile strength in the perpendicular direction (F2) is poor, but a restoring force is ensured against a depressed deformation.

Figure 22A:
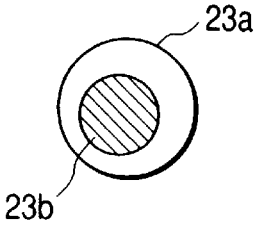

A look at this fibrous structure in more detail shows that, as illustrated in FIG. 21C, individual fibers are crimped and that a complicated net structure is formed and fusion-bonding occurs between adjacent fibers. Part of the crimped fibers face in the perpendicular direction (F2) to complete a three-dimensional fusion-bonding. The fibrous structure used actually in this example was formed as sliver using a tow of biaxial fibers in which polypropylene fibers as a core having a melting point of about 180° C. was coated nearly concentrically with polyethylene fibers having a melting point of about 132° C., as shown in FIG. 22A. In the fibrous structure thus used, there exists a main fiber arranged direction (F1), so if the fibrous structure is dipped in liquid, the interior fluidity and holdability in a stationary state are distinctly different between the fiber arranged direction (F1) and the direction (F2) perpendicular thereto.

Since in this example the element to be surface-modified is the fibrous structure whose liquid holdability is higher than that of an element having flat surfaces, there was used a treating solution of the following composition:

[Table 2]

TABLE 2

Composition of a fibrous member hydrophilizing solution

| Component | Composition (wt %) |
|---|---|
| (Polyoxyalkylene)-poly(dimethylsiloxane) | 0.40 |
| Sulfuric acid | 0.05 |
| Isopropyl alcohol | 99.55 |

(1) Hydrophilizing method for a PP-PE fibrous absorber

Figure 23A:
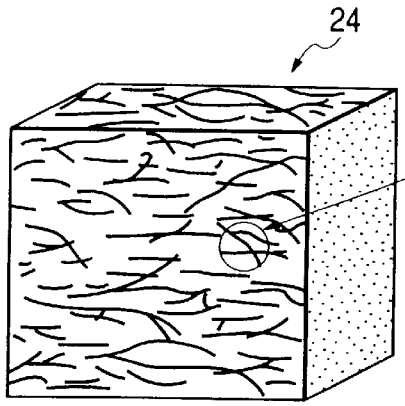
Figure 23D:
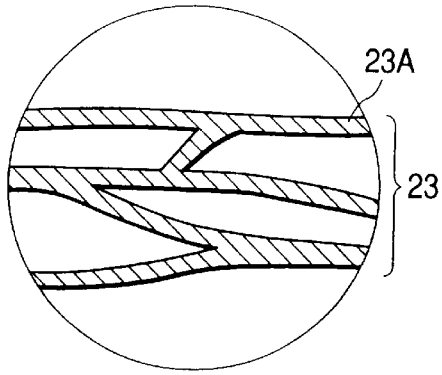
Figure 23B:
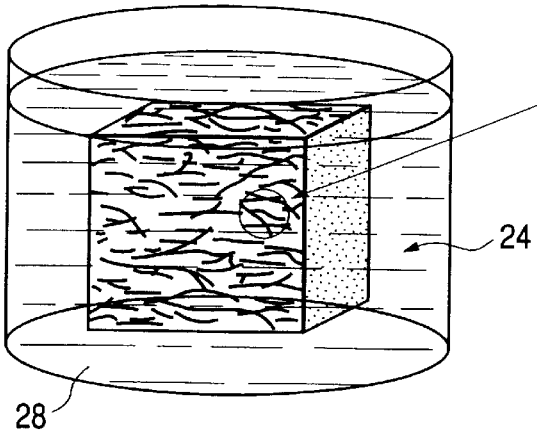
Figure 23E:
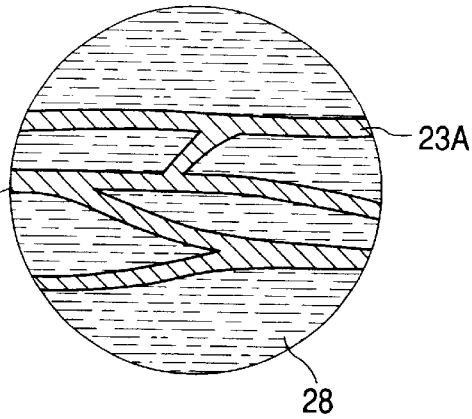
Figure 23C:
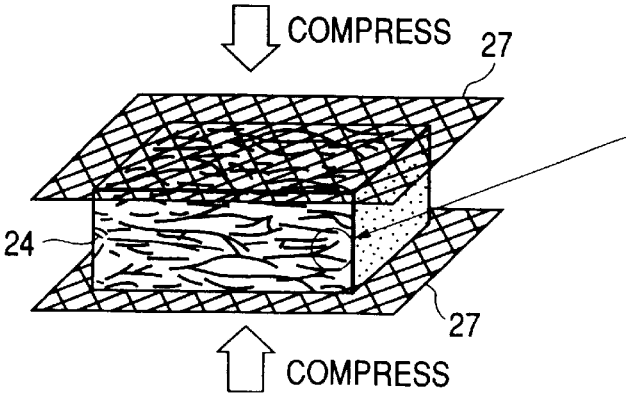
Figure 23F:
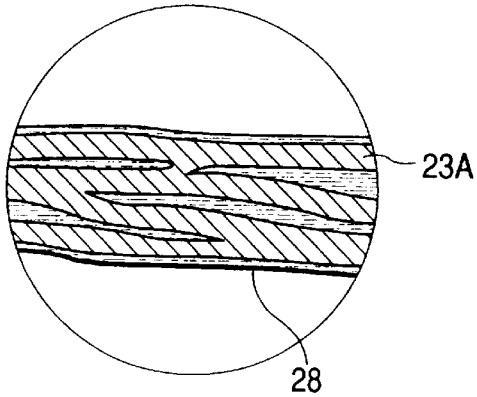
Figure 24A:
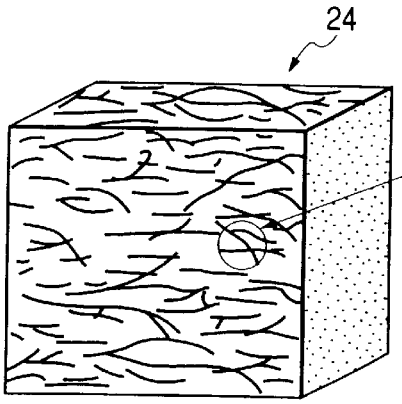
FIGS. 24A, 24B, 24C, 24D, 24E and 24F shows steps subsequent to the steps illustrated in FIGS. 23A to 23F, of which FIG. 24A schematically shows a coating layer formed on the surface of the fibrous member.
Figure 24D:
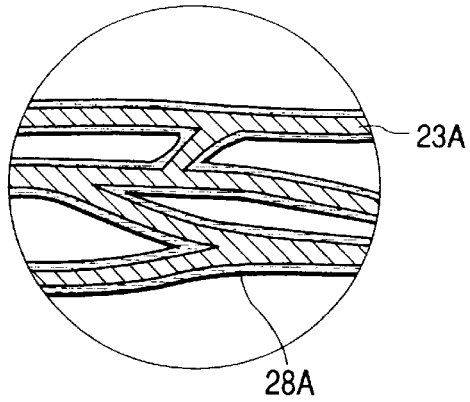
Figure 24B:
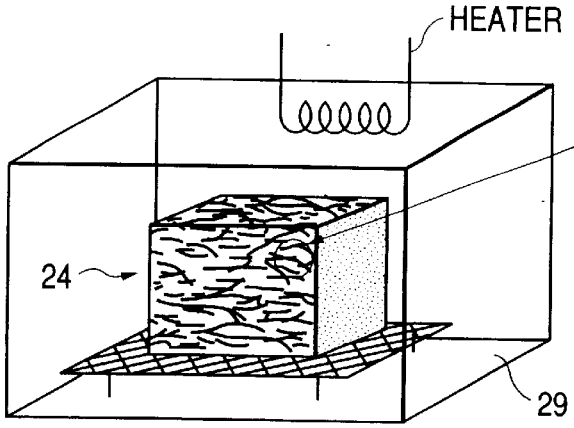
Figure 24E:
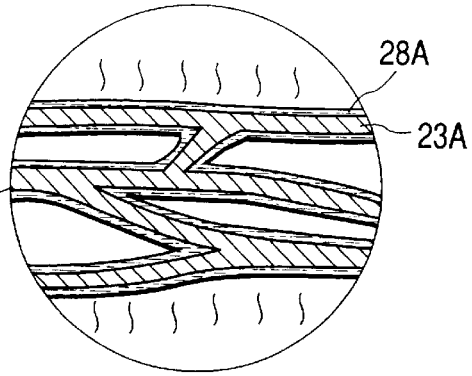

A polypropylene-polyethylene fibrous absorber 24 of the structure shown in FIG. 23A was dipped in a hydrophilizing solution 28 of the above composition (FIG. 23B). At this time, the treating solution is held in gaps of the fibrous absorber. Thereafter, the fibrous absorber was depressed (FIG. 23C) to remove a surplus portion of the treating solution 28 held in gaps of fibers 23A. When the fibrous absorber 24 is taken out from holding jigs 27 such as wire nets, it reverts to its original shape (FIG. 24A) with a liquid layer 28A formed on fiber surfaces. The fibrous absorber with wet fiber surfaces was dried in a 60° C. oven 29 for 1 hour (FIG. 24B). In this way it is possible to obtain a fibrous absorber 24 with a hydrophilized layer 28B formed on surfaces of the fibers 23A. FIGS. 23D to 23F are partially enlarged views of FIGS. 23A to 23C, respectively, and FIGS. 24D to 24F are partially enlarged views of FIGS. 24A to 24D, respectively.

COMPARATIVE EXAMPLE 1 AND REFERENCE EXAMPLE 1

As Comparative Example 1, the same operations as in the method described above in connection with FIGS. 23A to 23F and 24A to 24F were performed also with respect to the fibrous member hydrophilizing solution containing only sulfuric acid and isopropyl alcohol, which solution corresponds to the solution shown in Table 2 exclusive of (polyoxyalkylene)-poly(dimethylsiloxane). Further, an untreated PP-PE fibrous absorber was used as Reference Example 1.

In the above Principle Application Example 1, the amount of the hydrophilizing solution applied to the whole of the PP-PE fibrous absorber by the above application method is 0.3 to 0.5 g relative to 0.5 g of the fibrous absorber. Also in Comparative Example 1 the amount of the solution applied is the same as in the Principle Application Example 1.

The fibrous absorbers thus treated were then checked for surface-treated conditions in the following manner, the results of which are as set forth below.

(1) Hydrophilicity evaluating method for PP-PE fibrous absorber a) Pure water dropping evaluation using a squirt Using a squirt, pure water was dropped into each of the PP-PE fibrous absorber having been subjected to the treatment described in Principle Application Example 1, the PP-PE fibrous absorber of Comparative Example 1, and the untreated PP-PE fibrous absorber of Reference Example 1, and the degree of pure water permeation was observed.

b) Evaluation of pure water permeation

A container of a sufficient size for each PP-PE fibrous absorber was filled with pure water, then the PP-PE fibrous absorber of Principle Application Example 1, the PP-PE fibrous absorber of Comparative Example 1, and the untreated PP-PE fibrous absorber of Reference Example 1 were each put slowly into the container and checked for the degree of pure water permeation.

(2) Results of the hydrophilicity evaluation on PP-PE fibrous absorbers a) Results of the pure water dropping evaluation using a squirt When pure water was dropped from above to the PP-PE fibrous absorber of Principle Application Example 1 by means of a squirt, the pure water soaked into the fibrous absorber in an instant.

In contrast therewith, when pure water was dropped from above to each of the PP-PE fibrous absorber of Comparative Example 1 and the untreated PP-PE fibrous absorber of Reference Example 1, the pure water did not soak into the PP-PE fibrous absorbers at all, but formed spherical liquid droplets in a repulsive relation to the fibrous absorbers.

b) Results of the pure water dipping evaluation

When the PP-PE fibrous absorber of Principle Application Example 1 was put slowly into the container filled with pure water, it sank into the water slowly. This at least indicates that the surface of the PP-PE fibrous absorber having been treated by the method described above in connection with FIGS. 23A to 23F and 24A to 24F possesses a hydrophilic nature.

On the other hand, when the PP-PE fibrous absorber of Comparative Example 1 and the untreated PP-PE fibrous absorber of Reference Example 1 were put slowly into the pure water-filled container, both fibrous absorbers completely floated on the pure water. Even after the lapse of time both fibrous absorbers did not absorb water, thus clearing proving that they are water-repellent.

Figure 24C:
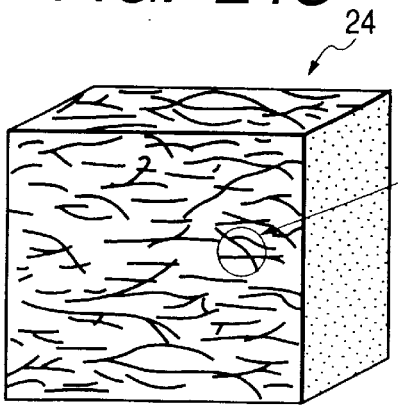
Figure 24F:
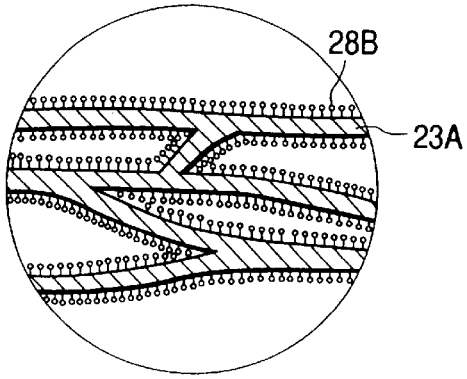

From the above results it is seen that even in the case of a PP-PE fibrous absorber, if a treating solution containing a polyalkylsiloxane having a polyalkylene oxide chain, an acid, and an alcohol is applied to the PP-PE fibrous absorber and then dried, there is formed such a coating of the polyalkylsiloxane as shown in FIG. 24C and that therefore the surface hydrophilization treatment is carried out effectively. As a result, the PP-PE fibrous absorber treated as above according to the present invention was found to fully function as an ink absorber even for a water-based ink.

For the purpose of confirming the above results, in other words, for making sure that the polyalkylsiloxane having a polyalkylene oxide chain adheres to the surfaces of PP-PE fibers and forms a polymer coating in the surface modification according to the present invention, there was made observation using SEM photographs of the fiber surfaces.

Figure 25:
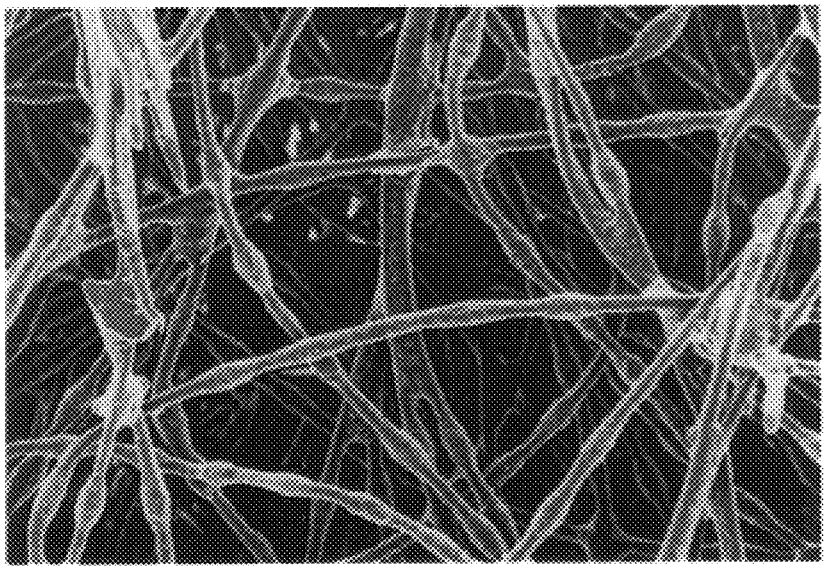
FIG. 25 is a magnified (150×) SEM photograph as a substitute for drawing, showing the shape and surface condition of an untreated PP-PE fibrous member in Reference Example 1 (untreated PP-PE fibrous absorber)
Figure 26:
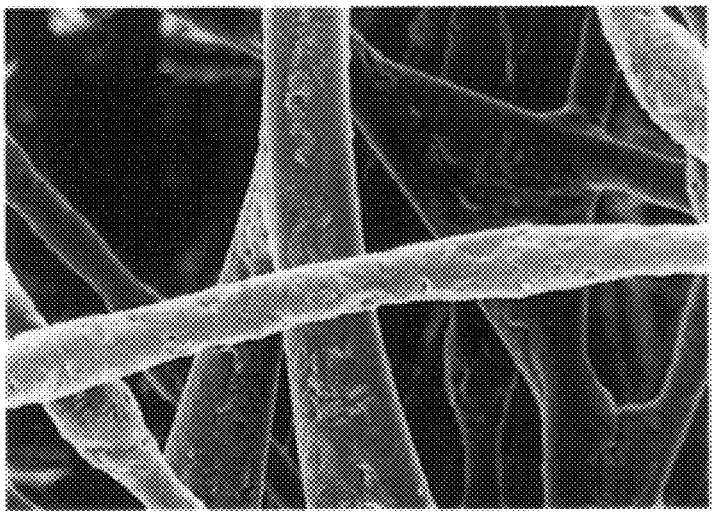
FIG. 26 is a magnified (500×) SEM photograph as a substitute for drawing, showing the shape and surface condition of an untreated PP-PE fibrous member in Reference Example 1 (untreated PP-PE fibrous absorber)
Figure 27:
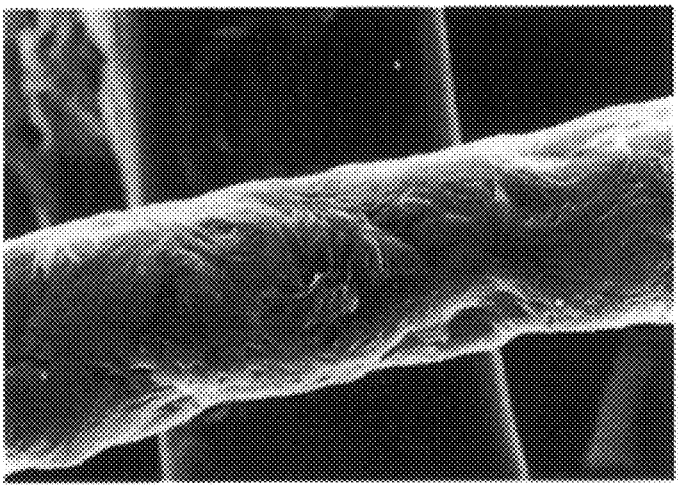
FIG. 27 is a magnified (2000×) SEM photograph as a substitute for drawing, showing the shape and surface condition of an untreated PP-PE fibrous member in Reference Example 1 (untreated PP-PE fibrous absorber)
Figure 28:
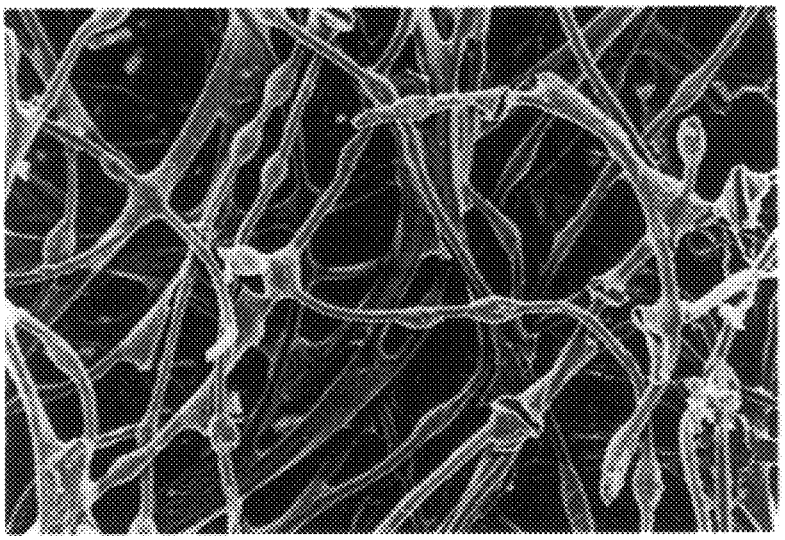
FIG. 28 is a magnified (150×) SEM photograph as a substitute for drawing, showing the shape and surface condition of an acid-treated PP-PE fibrous member in Comparative Example 1 (PP-PE fibrous absorber treated with only acid and alcohol)

FIGS. 25, 26 and 27 are enlarged SEM photographs showing surfaces of the untreated PP-PE fibers (fibrous absorber) of Reference Example 1. FIG. 28 is an enlarged SEM photograph showing surfaces of acid-treated PP-PE fibers (a PP-PE fibrous absorber treated with only acid and alcohol) of Comparative Example 4.

Figure 29:
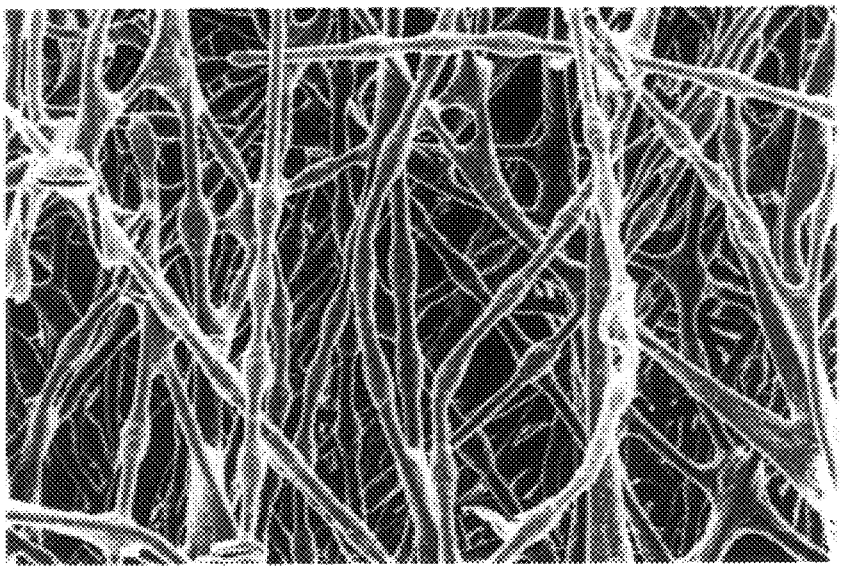
FIG. 29 is a magnified (150×) SEM photograph as a substitute for drawing, showing the shape and surface condition of a treated PP-PE fibrous member in Principle Application Example 1 (hydrophilized PP-PE fibrous absorber)
Figure 30:
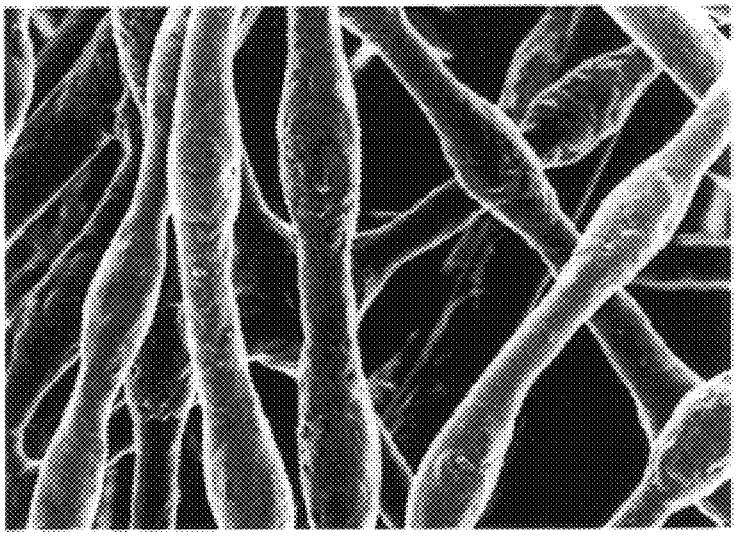
FIG. 30 is a magnified (500×) SEM photograph as a substitute for drawing, showing the shape and surface condition of a treated PP-PE fibrous member in Principle Application Example 1 (hydrophilized PP-PE fibrous absorber)
Figure 31:
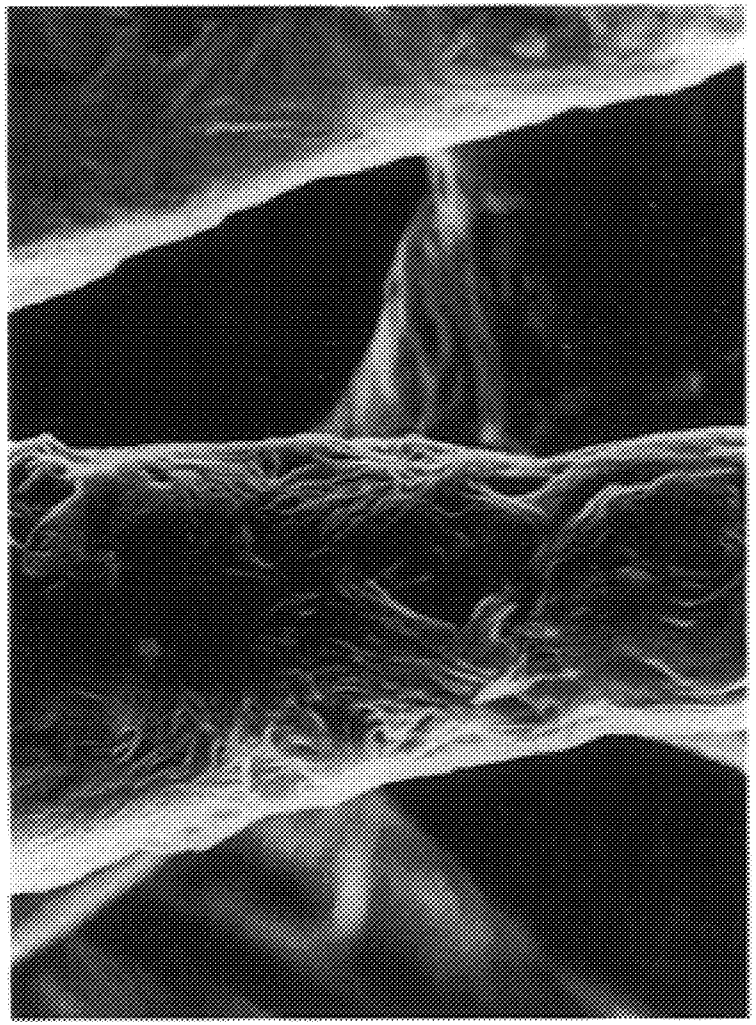
FIG. 31 is a magnified (2000×) SEM photograph as a substitute for drawing, showing the shape and surface condition of a treated PP-PE fibrous member in Principle Application Example 1 (hydrophilized PP-PE fibrous absorber)

FIGS. 29, 30 and 31 are enlarged SEM photographs showing surfaces of the treated PP-PE fibers (hydrophilized PP-PE fibrous absorber) described above in connection with FIGS. 23A to 23F and 24A to 24F.

First, in all of the enlarged SEM photographs of PP-PE fiber surfaces, it is impossible to observe any clear structural change considered attributable to the adhesion of an organic matter onto the fiber surfaces. Actually, even if a magnified (2000×) photograph of the untreated PP-PE fibers in FIG. 27 and that of the hydrophilized PP-PE fibers in FIG. 31 are compared with each other, no difference between the two is recognized in SEM observation of both fiber surfaces. Thus, it is presumed that the (polyoxyalkylene)-poly (dimethylsiloxane) in the hydrophilized PP-PE fibers is adhered uniformly as a thin film, which is presumed to be a monomolecular film, onto the fiber surfaces and that therefore it is morphologically impossible to make distinction from the original fiber surfaces and with no difference recognized in SEM observation.

On the other hand, reference to the SEM photograph of FIG. 28 showing PP-PE fibers treated with acid and alcohol alone shows that there occur many intersecting points (fusion-bonded portions) of fibers were broken and something like nodes are found in the fibers. This change indicates that the deterioration of PE-PP molecules, especially PE molecules on the skin layer, of the fiber surfaces was induced and accelerated with a highly concentrated acid by solvent evaporation and by the drying heat itself in the heat-drying process.

On the other hand, in the hydrophilization treatment using the hydrophilizing solution of Principle Application Example 1, such breakage of fiber connections and presence of node-like portions in fibers as observed in the PP-PE fibers treated with acid and alcohol alone are not recognized despite the same concentration of acid is contained therein and despite the same heat-drying was applied thereto. This fact indicates that the deterioration of PE molecules on the fiber surfaces was suppressed by the hydrophilization treatment of Principle Application Example 1. This is presumed to be because even in the event of breakage of PE molecules on the fiber surfaces under the action of acid and formation of radicals in the molecules, some substance and structure capture the radicals and prevent the radicals from destroying PE molecules in a series manner. The surface-adhered (polyoxyalkylene)-poly(dimethylsiloxane) also participates in the capture of radicals, and a chemical bond to the PE surface is formed in a capturing form for the radicals formed. Thus, there is no denying such a secondary phenomenon and effect as suppressing the destruction of PE/PP molecules by radical chain.

Taking all of the above points into account, it is presumed that the modification of fiber surfaces has been attained by the formation of a uniform thin film of (polyoxylakylene)-poly(dimethylsiloxane) on the fiber surfaces. In that process there also can be expected a cleaning effect for the fiber surfaces by both acid and solvent contained in the solution used for hydrophilization, and the action of accelerating a physical adsorption of the polyalkylene oxide chain is also expected. In addition, there also may be not a small possibility of a chemical linkage of the plyalkylene oxide chain with the broken portions of PE molecules caused by highly concentrated acid and heat.

Further, in Principle Application Example 1 it is shown that a polymer film can be formed easily even on fiber surfaces formed by curved surfaces, as shown schematically in FIG. 24C for example. Since the surface peripheral portion (a closed ring-like portion as a sectional outer periphery shape) is covered annularly with a polymer coating, the polymer coating can prevent easy separation of the surface-modified portion from the element.

Figure 22B:
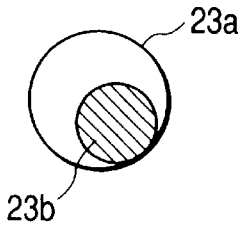

In biaxial fibers there sometimes is found such a case as shown in FIG. 22B in which a nuclear portion (core) 23*b* is eccentric and exposed partially to an outer wall surface, and thus the exposed surface of the nuclear portion and the surface of the skin layer (sheath) 23*a* are mixed together. Even in such a case, hydrophilic nature can be imparted to both the exposed nuclear portion and the skin layer surface by applying thereto the surface modifying method according to the present invention. In case of merely applying and drying a surfactant having a hydrophilizing function, there partially is obtained an initial hydrophilicity, but when the fibers are rubbed lightly with pure water, the surfactant will soon dissolve out into water, with loss of hydrophilicity.

PRINCIPLE APPLICATION EXAMPLES 2 AND 3

The following description is now provided about an example in which the above principle of surface hydrophilization is applied to a PP fibrous member. As the PP fibrous member there was used a lump of 2 denier dia. fibers formed in a rectangular parallelepiped shape of 2 cm×2 cm×3 cm.

First, there were prepared hydrophilizing solutions of the following two compositions:

[Table 3]

TABLE 3

Composition of a hydrophilizing solution

| Component | Composition (wt %) |
|---|---|
| (Polyoxyalkylene)-poly(dimethylsiloxane) | 0.1 |
| Sulfuric acid | 0.0125 |
| Isopropyl alcohol | 99.8875 |

[Table 4]

TABLE 4

Composition of a hydrophilizing solution

| Component | Composition (wt %) |
|---|---|
| (Polyoxyalkylene)-poly(dimethylsiloxane) | 0.1 |
| Sulfuric acid | 0.0125 |
| Isopropyl alcohol | 40.0 |
| Pure water | 59.8875 |

In the second composition (Principle Application Example 3), predetermined amounts of isopropyl alcohol and pure water are added in this order to afford the composition just tabulated above. Sulfuric acid and (polyoxyalkylene)-poly(dimethylsiloxane) contained in the composition are diluted to 4×.

In accordance with the hydrophilizing procedure for PP-PE fibrous absorbers described above in connection with FIGS. 23A to 23F and 24A to 24F there were obtained a PP fibrous member (Principle Application Example 2) treated with the solution of the first composition (Table 2) containing isopropyl alcohol as a main solvent and a PP fibrous member (Principle Application Example 3) treated with the solution of the second composition using a mixed solvent of water and isopropyl alcohol.

REFERENCE EXAMPLE 2

An untreated PP fibrous member was used as Reference Example 2.

As in Principle Application Example 1 the surface of the untreated PP fibrous member of Reference Example 2 is water-repellent, but was modified to a hydrophilic surface like the PP fibrous members of Principle Application Examples 2 and 3. For checking the degree of its hydrophilicity, 7 g of a water-based ink ($\gamma$=46 dyn/cm) was charged into a schale and the PP fibrous members of Principle Application Examples 2 and 3, as well as the untreated PP fibrous member of Reference Example 2, were put slowly onto the surface of the ink.

As a result, the untreated PP fibrous member of Reference Example 2 floated on the ink, while the PP fibrous members of Principle Application Examples 2 and 3 sucked up the ink from their bottoms. However, a comparison between the PP fibrous members of Principle Application Examples 2 and 3 showed a distinct difference in the amount of ink sucked up. The former sucked up and absorbed all of the ink from the schale, while as to the latter, about half of the ink remained in the schale.

This is presumed to be because of a difference in the degree of polymer orientation in the respective coatings although there is no substantially marked difference between both PP fibrous members in the total amount of (polyoxyalkylene)-poly(dimethylsiloxane) as a coating polymer on their surfaces.

For example, in the PP fibrous member of Principle Application Example 2, the surface coating polymer is substantially oriented, but is adhered to fiber surfaces in a partially orientation-disordered state. On the other hand, such an orientation disorder is diminished to a great extent in the PP fibrous member of Principle Application Example 3.

In the hydrophilization treatment using (polyoxyalkylene)-poly(dimethylsiloxane) it is presumed that a close and more uniformly oriented coating is attained by using water in addition to isopropyl alcohol as solvent. It is desirable for the treating solution to contain at least 20% or so of isopropyl alcohol to meet the requirement of uniform surface setting, but even in the case of an isopropyl alcohol content lower than 40% in the above Principle Application Example 3, it is possible to form a polymer coating. That is, in the course of solvent evaporation and drying, isopropyl alcohol volatilizes more rapidly and is lost, while the content of isopropyl alcohol decreases more. Taking this point into consideration, it is presumed that the coating can be effected even at an isopropyl alcohol content lower than 40%. From the standpoint of industrial safety it is preferable that the amount of isopropyl alcohol be less than 40%.

Although typical embodiments of the present invention have been described above, the invention is also applicable to, for example, such valve member 261, urging member 263 and valve lid 262 as shown in FIG. 12.

It goes without saying that the above modifying method, modified surfaces and technical idea on elements according to the present invention are also applicable to other porous elements than fibers as negative pressure generating members.

When the negative pressure generating member which has been hydrophilized uniformly by any of the above methods (other embodiments) sucks up ink (ink) again after the ink once absorbed into the negative generating member has been extracted, as referred to in the previous description, the amount of ink held by the negative pressure generating member after the repeated ink suction is almost the same as before, in other words, a return to the initial negative pressure can be effected, irrespective of the amount of ink extracted or the number of times of suction repetition.

On the other hand, in the embodiment in which the liquid containing chamber is disposed removably with respect to the negative pressure generating member containing chamber, the amount of liquid held in the negative pressure generating member containing chamber at the time of replacing the liquid containing chamber varies, depending on the case where liquid is held up to near the joint pipe which is a connection to the ink outlet port, the case where even liquid present near the ink feed port is consumed, and the case where there is no ink capable of being consumed (fed). In accordance with any of the above methods (other embodiments) according to the present invention, by applying the hydrophilization treatment to the negative pressure generating method in the negative pressure generating member containing chamber, the negative pressure in the ink feed port portion of the negative pressure generating member containing chamber after replacement of the liquid containing chamber can be always restored to its initial level (negative pressure and amount) irrespective of the number of times of replacement and the residual amount of liquid in the negative pressure generating member containing chamber before replacement. When the partial hydrophilization according to the present invention is considered, if liquid remains near the treating portion in the negative pressure generating member before replacement (for example if only the liquid remaining in the vicinity of the joint pipe is consumed), it suffices for the hydrophilization treatment to cover the area from the liquid-supplemented portion up to the liquid-consumed portion even if the whole of the negative pressure generating member is not hydrophilized in the manner described above.

According to the present invention, as set forth above, since a partial surface of a portion through which a recording liquid used in a recording liquid feed device passes directly or of a structure necessary for the feed of the recording liquid is rendered hydrophilic, there can be provided a recording liquid feed device capable of feeding the recording liquid stably and efficiently.

More specifically, by hydrophilizing an inner surface of a feed tube which is for conducting the recording liquid from the recording liquid container to the liquid ejection head, it is possible to prevent air from entering the feed tube and forming a bubble which would stay and obstruct the flow of the recording liquid and hence possible to conduct the recording liquid smoothly from the recording liquid container to the ink jet head. Moreover, by so doing, the feed tube continuity can be recovered easily with use of recovery means such as suction or the application of pressure. By the hydrophilization treatment according to the present invention, a hydrophilized surface using a molecular level of a thin polymer film can be formed on the feed tube inner surface with little change in inside diameter.

In the case where a filter is disposed in the recording liquid feed port of the recording liquid container, by lyophilizing the filter surface it becomes possible to reduce a pressure loss caused by the filter and conduct and feed the recording liquid efficiently to the feed port.

Structural members such as tube, pipe and filter having been lyophilized according to the present invention can exhibit a lyophilic nature and air permeation and elution preventing effect within the liquid feed path.

Moreover, in a recording liquid container having an absorber containing chamber with an absorber inserted therein and also having a liquid storage chamber with a recording liquid stored therein directly, by lyophilizing a contact surface with the absorber of the absorber containing chamber on the side where a communicating portion of the absorber containing chamber with the liquid storage chamber is connected, it is possible to further stabilize gas-liquid exchange and feed liquid in a stabler manner. In the case where the liquid storage chamber and the absorber containing chamber are connected together through a relatively long joint pipe, by rendering an inner surface of the joint pipe lyophilic, it becomes possible to conduct the liquid stored in the liquid storage chamber to the joint pipe portion and feed it efficiently into the absorber containing chamber. In addition, according to the lyophilizing method of the present invention, it is possible to apply the lyophilization treatment to at least a part of the negative pressure generating member, whereby it is possible to improve the liquid absorbability of the negative pressure generating member, diminish the flow resistance of liquid within the negative pressure generating member and feed liquid efficiently.

According to the present invention, the wettability of liquid for the liquid feed path as a portion where liquid itself passes directly for liquid feed or as a structure necessary for liquid feed is improved and it becomes difficult for a bubble to adhere to the liquid feed path, and even if it is left standing for a long period, the bubble is difficult to grow. Thus, the adhesion and stay of a bubble in the feed path are suppressed and the deterioration of liquid feedability is difficult to occur.

Further, by applying the lyophilization treatment to a partition wall on the absorber containing chamber side of a liquid container having the partition wall, it is possible to prevent an accidental formation of an air path between the wall surface and the absorber and the introduction of gas can be performed along a predetermined route, so that the gas-liquid exchanging operation can be stabilized and it is possible to improve the reliability of liquid feed.

What is claimed is:

1. A recording liquid feed path formed in a tubular shape as a portion through which a recording liquid itself passes directly or as a structure necessary for the feed of the recording liquid, the recording liquid being fed to an ink jet head which ejects the recording liquid to effect recording, comprising:

a polymer applied to an inner surface of the recording liquid feed path, the polymer having a first moiety containing a lyophilic group for making the inner surface of the recording liquid feed path hydrophilic, and a second moiety containing a group having an interfacial energy different from an interfacial energy of the lyophilic group and almost equal to a surface energy of said inner surface, the second moiety being oriented toward said inner surface which direction is different from an orienting direction of the first moiety;

wherein the inner surface of the recording liquid feed path is constituted by an olefin resin, and the polymer is a polyalkylsiloxane containing a hydrophilic group.

2. A recording liquid feed device comprising the recording liquid feed path according to claim 1.

3. A recording liquid feed system comprising a first container, the first container containing an absorber which holds a recording liquid to be fed to an ink jet head temporarily with a capillary force, a second container which holds a recording liquid to be fed to the first container, and a tubular recording liquid feed path for communication between the first and second containers, wherein the absorber is a fibrous member constituted by a fiber having an olefin resin at least on its surface, wherein an inner surface of the recording liquid feed path has an olefin resin, wherein the surface of the fibrous member and the inner surface of the recording liquid feed path are each applied with a polymer at least partially, the polymer having a first moiety containing a lyophilic group for lyophilization and a second moiety containing a group having an interfacial energy different from an interfacial energy of the lyophilic group and almost equal to a surface energy of said surfaces of the fibrous member and the recording liquid feed path, the second moiety being oriented toward said surfaces, and the first moiety being oriented in a direction different from said surfaces, and wherein the polymer applied to the fibrous member is a polyalkylsiloxane containing a hydrophilic group.

4. A recording liquid feed device for feeding a recording liquid to an ink jet head which ejects the recording liquid for adhesion to a recording medium to effect recording, comprising:

a polymer applied to a partial surface of a path portion through which the recording liquid passes directly and applied also to a partial surface of a negative pressure generating member which feeds the recording liquid while generating a negative pressure, the polymer having a first moiety containing a lyophilic group for making said surfaces lyophilic and a second moiety containing a group having an interfacial energy different from an interfacial energy of the lyophilic group and almost equal to a surface energy of said surfaces, the second moiety being oriented toward said surfaces, and the first moiety being oriented in a direction different from said surfaces, and wherein said surfaces are each constituted by an olefin resin, and the polymer is a polyalkylsiloxane containing a hydrophilic group.

5. The recording liquid feed device according to claim 4, wherein said surfaces of said path portion and of said negative pressure generating member include an inner surface of a tubular recording liquid feed path as a portion through which the recording liquid passes directly so as to be fed or as a structure necessary for the feed of the recording liquid, and wherein said surfaces also include surfaces of fibers of an absorber which holds the recording liquid temporarily with a capillary force and which is constituted by the fibers.

6. The recording liquid feed device according to claim 4, wherein a polymer is applied to a partial surface different from said lyophilized partial surface of the portion through which the recording liquid passes directly or said lyophilized partial surface of the structure necessary for the feed of the recording liquid, the polymer having a first moiety containing a liquid-repellent group for making said different partial surface liquid-repellent and a second moiety containing a group having an interfacial energy different from an interfacial energy of the liquid-repellent group and almost equal to a surface energy of said different partial surface, the second moiety being oriented toward said different partial surface which orienting direction is different from an orienting direction of the first moiety.

* * * * *

UNITED STATES PATENT AND TRADEMARK OFFICE

CERTIFICATE OF CORRECTION

PATENT NO. : 6,709,092 B2
DATED : March 23, 2004
INVENTOR(S) : Hiroki Hayashi et al.

It is certified that error appears in the above-identified patent and that said Letters Patent is hereby corrected as shown below:

Title page,
Item [*] Notice, "Subject to any disclaimer, the term of this patent is extended or adjusted under 35 U.S.C. 154(b) by 195 days" should read -- Subject to any disclaimer, the term of this patent is extended or adjusted under 35 U.S.C. 154(b) by 108 days. --.

Signed and Sealed this

Twenty-ninth Day of November, 2005

JON W. DUDAS
*Director of the United States Patent and Trademark Office*